US007543399B2

(12) United States Patent
Kilgore et al.

(10) Patent No.: US 7,543,399 B2
(45) Date of Patent: Jun. 9, 2009

(54) FOOTWEAR INCLUDING REPLACEABLE OUTSOLE MEMBERS

(75) Inventors: Bruce J. Kilgore, Lake Oswego, OR (US); Thomas Berend, Beaverton, OR (US); Anthony Carl Dean, Sherwood, OR (US); Anthony P. Daversa, Beaverton, OR (US); Lawrence P. Eisenbach, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 684 days.

(21) Appl. No.: 10/986,166

(22) Filed: Nov. 12, 2004

(65) Prior Publication Data

US 2006/0101671 A1 May 18, 2006

(51) Int. Cl.
*A43B 13/00* (2006.01)
*A43B 13/26* (2006.01)

(52) U.S. Cl. ..... 36/101; 36/15

(58) Field of Classification Search ..... 36/15, 36/31, 100, 103, 25 R
See application file for complete search history.

(56) References Cited

U.S. PATENT DOCUMENTS

| | | | |
|---|---|---|---|
| 754,673 | A | 3/1904 | Mitchell |
| D94,865 | S | 3/1935 | Sulivan |
| D96,093 | S | 7/1935 | Cohen |
| D102,122 | S | 12/1936 | Berman |
| D103,018 | S | 2/1937 | Liberty |
| D103,218 | S | 2/1937 | Cohen |
| D103,301 | S | 2/1937 | Borda |
| D103,411 | S | 3/1937 | Sholtz |
| D102,898 | S | 7/1937 | Kalmon |
| D108,320 | S | 2/1938 | Eldon |
| 2,119,392 | A | 5/1938 | Levin |
| D112,344 | S | 11/1938 | Lutz |
| D140,573 | S | 3/1945 | Sandler |
| 3,076,273 | A | 2/1963 | Wyllie |
| 3,763,578 | A | 10/1973 | Chadwell |

(Continued)

FOREIGN PATENT DOCUMENTS

DE 2255628 A1 5/1974

(Continued)

OTHER PUBLICATIONS

Nike Footwear Catalog Holiday 1994, p. 64, published Mar. 1994.

(Continued)

*Primary Examiner*—Jila M Mohandesi
(74) *Attorney, Agent, or Firm*—Banner & Witcoff, Ltd.

(57) ABSTRACT

Footwear including removable and replaceable outsole members may include: (a) an upper member; (b) a midsole member, having an exterior surface not designed for performance use in direct contact with the ground, fixedly engaged with the upper member; and (c) an outsole member designed for performance use in contact with the ground removably attached over at least a major portion of the midsole member. The outsole member may attach to the midsole member and/or upper member in a variety of different ways. In use, the wearer may select a specific set of outsole members to use at a given time depending, for example, on the type of play surface, temperature, and/or other conditions. Worn outsole members may be replaced without the expense involved in also replacing the remainder of the footwear.

46 Claims, 12 Drawing Sheets

U.S. PATENT DOCUMENTS

| | | | | |
|---|---|---|---|---|
| 4,267,650 | A | 5/1981 | Bauer | |
| 4,279,083 | A * | 7/1981 | Dilg | 36/101 |
| 4,299,037 | A | 11/1981 | Carey | |
| 4,317,294 | A | 3/1982 | Goodyear | |
| 4,377,042 | A | 3/1983 | Bauer | |
| D283,173 | S | 4/1986 | Malone | |
| 4,779,360 | A | 10/1988 | Bible | |
| D321,970 | S | 12/1991 | Cochran | |
| 5,083,385 | A | 1/1992 | Halford | |
| D333,032 | S | 2/1993 | Hatfield | |
| D336,148 | S | 6/1993 | Adams | |
| D345,458 | S | 3/1994 | Lacoraza et al. | |
| 5,315,767 | A | 5/1994 | Bradbury | |
| 5,661,915 | A | 9/1997 | Smith | |
| D394,740 | S | 6/1998 | Poust | |
| D398,761 | S | 9/1998 | Smith, III | |
| D398,766 | S | 9/1998 | Avar | |
| D407,550 | S | 4/1999 | Clarke | |
| 5,894,682 | A * | 4/1999 | Broz | 36/31 |
| D412,776 | S | 8/1999 | Biedermann | |
| D415,879 | S | 11/1999 | Lupo | |
| 5,992,053 | A | 11/1999 | Hansen | |
| 6,023,859 | A | 2/2000 | Burke et al. | |
| D432,781 | S | 10/2000 | Hardy | |
| D440,034 | S | 4/2001 | Matis | |
| D447,618 | S | 9/2001 | Matis et al. | |
| D448,148 | S | 9/2001 | Matis et al. | |
| D452,067 | S | 12/2001 | Matis et al. | |
| 6,345,454 | B1 | 2/2002 | Cotton | |
| D471,350 | S | 3/2003 | Roulo | |
| D476,145 | S | 6/2003 | Adams et al. | |
| D480,545 | S | 10/2003 | Matis et al. | |
| D480,548 | S | 10/2003 | Matis et al. | |
| D486,627 | S | 2/2004 | Rogers et al. | |
| D487,619 | S | 3/2004 | Matis | |
| 6,722,061 | B2 | 4/2004 | Auger et al. | |
| D496,152 | S | 9/2004 | Doxey | |
| D498,044 | S | 11/2004 | Morris | |
| D498,583 | S | 11/2004 | Yun | |
| 6,813,847 | B2 * | 11/2004 | Workman | 36/15 |
| D499,875 | S | 12/2004 | Lozano | |
| 6,931,766 | B2 * | 8/2005 | Greene | 36/101 |
| 6,948,261 | B1 * | 9/2005 | Grasso | 36/15 |
| 2003/0051372 | A1 | 3/2003 | Lyden | |
| 2003/0069807 | A1 | 4/2003 | Lyden | |
| 2003/0088996 | A1 | 5/2003 | Hall | |
| 2004/0068890 | A1 | 4/2004 | Palahnuk | |
| 2005/0188562 | A1 | 9/2005 | Clarke | |
| 2005/0274042 | A1 * | 12/2005 | Issler | 36/15 |

FOREIGN PATENT DOCUMENTS

| | | | |
|---|---|---|---|
| EP | 0 565 913 | A1 | 3/1993 |
| EP | 1369048 | A | 12/2003 |
| WO | WO 86/04489 | | 8/1986 |

OTHER PUBLICATIONS

Nike Footwear Catalog Fall 1996, p. 188, published Dec. 1995.
Nike Footwear Catalog Fall 1999, p. W105, published Nov. 1998.
Nike Footwear Catalog Holiday 2000, p. W52, published Mar. 2000.
Nike Footwear Catalog Spring 2001, p. M38, published Jun. 2000.
Nike Footwear Catalog Spring 2001, p. M122, published Jun. 2000.
Nike Footwear Catalog Late Spring 2001, p. M6, published Sep. 2000.
Nike Footwear Catalog Holiday 2002, p. M9, published Mar. 2002.
Nike Footwear Catalog Holiday 2002, p. M21, published Mar. 2002.
Nike Footwear Catalog Late Spring 2003, p. W4, published Sep. 2002.
Nike Footwear Catalog Late Spring 2003, p. W19, published Sep. 2002.
Nike Footwear Catalog Late Spring 2003, p. W49, published Sep. 2002.
Nike Footwear Catalog Fall 2003, p. W59, published Nov. 2002.
Nike Footwear Catalog Holiday 2003, p. W47, published Mar. 2003.
Internet printout: Air Ovidian—http://www.geocities.com/yellownikefreak/AirOvidian.html dated Jun. 21, 2004.
Internet printout: Health News—http://www.detnews.com/2000/health/1219/news.htm dated Jun. 18, 2004.
Internet printout: Core 77 Design News—Oct. 2000—http://www.core 77.com/news/archive_10_00.html dated Jun. 18, 2004.
Internet printout: f.uk fashion news: Inside out—http://www.widemedia.com/fashionuk/news/2000/06/20/news0000481.htm dated Jun. 18, 2004.
Internet printout: http://www.hidemarket.com/public/news/2000/news090900.htm dated Jun. 21, 2004.
International Search Report and Written Opinion dated Feb. 14, 2006.

* cited by examiner

FOOTWEAR INCLUDING REPLACEABLE OUTSOLE MEMBERS

FIELD OF THE INVENTION

Aspects of the present invention generally relate to removable and replaceable outsole members, footwear products and footwear systems including these outsole members, and methods of using such footwear products. Such products and methods are particularly useful for athletic footwear or other footwear products subjected to hard use that tends to rapidly deteriorate conventional footwear outsoles.

BACKGROUND

Tennis is played on a wide variety of court surfaces, including, for example, grass, clay, hardcourt, concrete, asphalt, OmniCourt™ or other synthetic surfaces, etc. Some of these surfaces, particularly hardcourt, concrete, and asphalt, can be very hard on footwear, particularly on the outsole structure of the footwear and any other portion that regularly contacts the ground. As an example, the average life of a tennis shoe outsole, at a collegiate level of play, when used on a hardcourt surface, is about 40 hours. Therefore, high volume players, such as professional, collegiate, or high school athletes, typically need to replace their shoes about once a month or even more often.

Because tennis is a year-round activity for at least some players, particularly in warmer climates and/or for those with access to heated or indoor facilities, a high volume player may find it necessary to purchase new shoes frequently throughout the year. In light of the relatively high cost associated with high quality tennis footwear (e.g., in many instances over $100 per pair), shoe replacement costs at this frequent rate can be substantial and burdensome. Players that use excessively worn footwear, on the other hand, run an increased risk of injury from slips, slides, and footwear failure during use. Breaking in new shoes also involves injury risk, e.g., from blisters, improper fit, etc. Additionally, worn footwear or "un-broken in" footwear, in at least some instances, can adversely affect the user's performance, potentially costing points, games, sets, etc.

Tennis is not the only athletic or recreational endeavor that can be tough on footwear. For example, footwear used in skateboarding, cycling competitions (e.g., ramp jumping, SuperBMX, freestyle, supercross, motocross, etc.), basketball (particularly street basketball), volleyball, and the like, can wear very quickly, particularly under a high volume of use. Active children and adolescents also can be extremely tough on footwear and can wear through shoe outsoles very quickly. Substantial costs can be involved in frequent replacement of footwear used in these types of activities or by these users.

In some instances, footwear also can be exposed to a wide variety of conditions in use. Returning to the example of tennis, a player's tennis shoe outsoles typically are the only direct interface between the athlete and the court surface. In addition to the different potential surface types, as described above, the court surface also may be exposed to a wide variety of conditions, and play may take place under a variety of conditions. For example, in some instances the court may be wet or damp, depending on the local weather, humidity, groundskeeping, and the like. As additional examples, depending on the ambient temperature, the presence of sunshine or wind, the court surface, and the like, the court surface temperature during play or practice can vary widely, typically from as low as 50° F. or even lower, to as high as 120° F. or even higher. A single outsole material, design, and/or construction may not be suitable or optimal for use under this myriad of conditions. Purchasing, storing, and transporting numerous pairs of shoes to events in an effort to accommodate and optimize performance under a wide variety of potential conditions further increases the expense and burden associated with at least some athletic or recreational endeavors, particularly for high quality, competitive players.

Other athletic events also take place under a variety of different conditions, including different play conditions and/or different surface conditions. For example, track and field events may take place on a variety of different track or other field surfaces, and/or the events may take place under a wide variety of weather conditions (e.g., heat, cold, wet, dry, etc.). No single pair of shoes, including the uppers and outsoles, is necessarily best or optimized for use under this wide variety of potential track and field conditions.

Accordingly, there is a need in the art for footwear products, footwear systems, and methods that can reduce costs associated with footwear, particularly footwear used under high volume and/or heavy wear conditions. It would be advantageous, in at least some instances, if such products, systems, and methods further were capable of helping to optimize user performance, optionally taking into account a variety of use, ground surface, weather, and/or other conditions.

SUMMARY

Aspects of the present invention relate to removable and replaceable outsole members, footwear products and/or footwear systems including these outsole members, and methods of using such footwear products and systems. Footwear products in accordance with at least some examples of this invention may include: (a) an upper member including a closure system; (b) a midsole member fixedly engaged with the upper member, wherein at least a major portion of the exterior surface of the midsole member is not designed for performance use in direct contact with a ground surface; and (c) an outsole member removably attachable over at least a major portion of the exterior major surface of the midsole member (e.g., stretched over the midsole) and designed for performance use in contact with the ground (e.g., designed for use in an athletic event or other performance). The outsole member further may include an engagement element on its interior major surface that engages with a corresponding engagement element provided on a major exterior surface of the midsole member. Additionally, the outsole member further may include an upper containing region that extends over and partially contains the upper member, wherein the upper containing region also at least partially covers the closure system. If desired, one or more additional outsole elements may be attached to the exterior major surface of the outsole member, e.g., to further increase its wear-resistance or change its tread characteristics in areas of traditionally high wear or ground contact.

Footwear products in accordance with additional example aspects of this invention may include: (a) an upper member including a closure system; (b) a midsole member fixedly engaged with the upper member, wherein an exterior major surface of the midsole member includes at least a first groove element defined therein; and (c) an outsole member removably attachable over at least the major portion of the exterior major surface of the midsole member, wherein an interior major surface of the outsole member includes at least a first raised rib element that engages with the first groove element defined in the midsole member, and wherein the outsole member further includes an upper containing region that extends over and partially contains the upper member, wherein the upper containing region at least partially covers the closure system. If desired, the major exterior surface of the midsole member may include multiple grooves that extend in different directions (e.g., substantially longitudinally and/or substantially transversely) that engage with multiple raised ribs provided in the major interior surface of the outsole member.

Additional aspects of this invention relate to footwear systems. In at least one example, the footwear system may include a pair of footwear or shoe bases (e.g., upper members and midsoles, for example, like those described above, optionally, where at least a major portion of the midsole's exterior surface is not designed for performance use in direct contact with the ground surface) and multiple pairs of removable outsole members or means for obtaining additional removable outsole members, e.g. like those described above. The removable outsole members may be freely engaged with and disengaged from the shoe bases, and the individual outsole member selected for a specific use may depend on various factors, such as field or ground surface composition or conditions, user preference, weather, or other conditions, etc. If desired, one pair of outsole members may be designed for use on one type of ground surface (e.g., a hardcourt tennis court surface) or under one set of play conditions (e.g., wet or cool conditions), while another pair may be designed for use on a different type of ground surface (e.g., a clay court surface, a grass court surface, or the like) or under different play conditions (e.g., dry or hot conditions). Alternatively, if desired, at least some of the outsole members may be designed the same such that one pair can replace another pair when it is worn out.

As another example, users may have multiple "base shoes" or upper and midsole members with varying characteristics, e.g., minimal lightweight base shoes, more supportive base shoes, more breathable base shoes, more water-resistant base shoes, etc. The plural upper members, optionally along with plural outsole members of varying characteristics, may provide a wide ranging pallet of footwear products, e.g., for use under a variety of use and/or ambient conditions, for varying aesthetic looks, etc.

Still additional aspects of this invention relate to methods of using footwear systems including the footwear systems described above. As examples, methods in accordance with this invention may include: (a) determining a type of surface or play conditions on which an event will be performed; (b) selecting a pair of outsole members, at least in part, based on the type of surface or play conditions; and (c) removably attaching the pair of outsole members to a pair of shoe base members. Methods according to aspects of the present invention further may include one or more of the following additional steps: performing the event wearing a pair of shoes including the pair of shoe base members with the pair of outsole members attached thereto; determining at least one additional condition at a location at which the event will be performed, wherein the step of selecting the outsole member additionally may take the determined additional condition into account; removing a previously selected pair of outsole members from the pair of shoe base members; and removably attaching a new pair of outsole members to the shoe base members.

BRIEF DESCRIPTION OF THE DRAWINGS

The above and other objects, features, and advantages of the present invention will be more readily apparent and more fully understood from the following detailed description, taken in conjunction with the appended drawings, which illustrate examples of the present invention, wherein.

DETAILED DESCRIPTION

Figure 1:
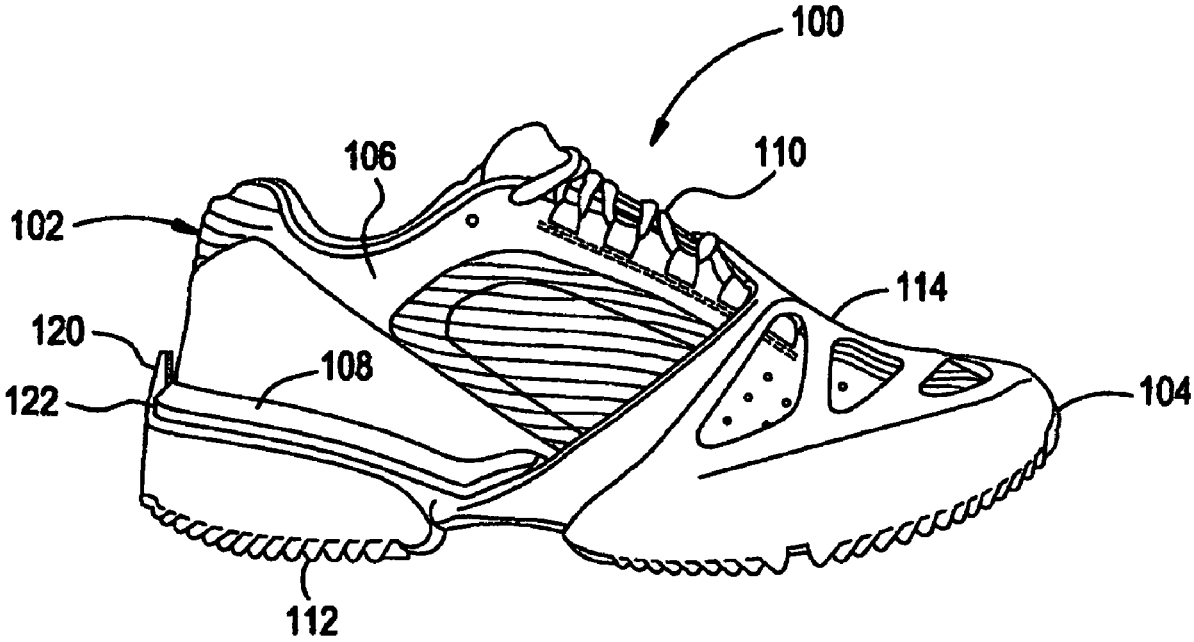
FIG. 1 illustrates an example footwear system in accordance with this invention, including a footwear base member and a removable outsole member.

Various specific examples of structures and methods in accordance with this invention are described in detail below in conjunction with the attached drawings. To assist the reader, this specification is divided into various subsections, as follows: Terms; General Description of Aspects of the Invention; Specific Examples of the Invention; and Conclusion.

A. TERMS

The following terms are used in this specification, and unless otherwise noted or clear from the context, these terms have the meanings provided below.

"Footwear" means any type of wearing product for the feet, and this term includes, but is not limited to: all types of shoes, boots, sneakers, sandals, thongs, flip-flops, mules, scuffs, slippers, sport-specific shoes (such as golf shoes, ski boots, etc.), and the like.

"Ground surface" or "surface" means any surface, indoors or outdoors, onto which a user's foot contacts and/or onto which a user's foot is intended to contact, e.g., during play of an athletic event, practice, or other performance.

"Performance use" or "athletic use" means use of a footwear product in its intended manner and in its intended environment, e.g., during play of an athletic event, practice, or other performance.

B. GENERAL DESCRIPTION OF ASPECTS OF THE INVENTION

In general, aspects of this invention relate to footwear products that include a removable outsole member that may be removed and replaced, for example, when worn out, when play takes place on different ground surfaces (e.g., grass, clay, concrete, hardcourt surfaces, asphalt surfaces, etc.), for customization purposes, etc. In at least some examples, footwear products in accordance with aspects of this invention may include: (a) an upper member including a closure system; (b) a midsole member fixedly engaged with the upper member, wherein an exterior major surface of the midsole member optionally includes at least a first engagement element, and, optionally, wherein at least a major portion of the exterior major surface is not designed for performance use in direct contact with a ground surface; and (c) an outsole member, designed for performance use in direct contact with the ground surface, removably attachable over at least a major portion of the exterior major surface of the midsole member (e.g., stretched over at least the portion of the midsole member's exterior major surface not designed to directly contact the ground in performance use). The outsole member may, in at least some examples, include various additional features in accordance with additional aspects of this invention. For example, an interior major surface of the outsole member may include a second engagement element that engages with the first engagement element of the midsole member. Additionally or alternatively, the outsole member may include an upper containing region that extends over and partially contains the upper member, optionally, wherein the upper containing region also at least partially covers the closure system. If desired, one or more additional outsole elements may be attached to the exterior major surface of the outsole member, e.g., to further increase its wear-resistance and/or change its tread characteristics in areas of traditionally high wear or ground contact.

At least some examples of this invention relate to footwear products that include: (a) an upper member including a closure system; (b) a midsole member fixedly engaged with the upper member, wherein an exterior major surface of the midsole member includes at least a first groove element defined therein; and (c) an outsole member removably attachable over at least the major portion of the exterior major surface of the midsole member, wherein an interior major surface of the outsole member includes at least a first raised rib element that engages with the first groove element defined in the midsole member, and wherein the outsole member further includes an upper containing region that extends over and partially contains the upper member, wherein the upper containing region at least partially covers the closure system. If desired, the major exterior surface of the midsole member may include multiple grooves that extend in different directions (e.g., substantially longitudinally and/or substantially transversely) that engage with multiple raised ribs provided in the major interior surface of the outsole member.

In at least some examples of the invention, the outsole member and at least one of the midsole member or the upper member may include attachment elements that help secure the outsole member to the remainder of the piece of footwear. These attachment elements may be located at any suitable or desired position in the footwear, such as in the heel area, along the lateral or medial sides, in the toe area, etc. One or more of these attachment elements, or a combination thereof, may produce an indication when the outsole member is properly seated on the remainder of the piece of footwear, such as a visual indicator, an audible indicator, or the like.

As noted above, in at least some examples, an upper containing region of the outsole member may extend over and partially contain the upper member and the closure system. This upper containing region may be constructed from a flexible material such that it moves, bends, and/or otherwise accommodates changes in position or shape of the upper member portion contained therein, e.g., during use in an athletic event or practice. Additionally, in at least some examples of this invention, the upper member may actually attach to the upper containing region, e.g., using the closure system of the upper member.

When used, particularly in athletic use or performance use, the outsole member generally must remain securely in place with respect to the midsole member and/or the upper member, e.g., to avoid slipping. The attachment elements and engagement elements described above (and described in more detail below) assist in this effort. Various ways of maintaining the relative position of the midsole and outsole members may be used in accordance with the invention. For example, the major exterior surface of the midsole member may include one or more grooves (e.g., elongated grooves) that engage one or more corresponding raised ribs (e.g., elongated ribs) on the major interior surface of the outsole member, and vice versa, to help fix the two members together and to help prevent them from moving with respect to one another. If desired, each of the midsole member and the outsole member may include a combination of grooves and/or raised ribs that engage with complementary elements on the other member without departing from the invention.

As a further or alternative aid to help hold the outsole member to the midsole and/or upper member, in at least some examples of the invention, at least one of the exterior major surface of the midsole member and the interior major surface of the outsole member may be constructed or treated so as to increase the coefficient of friction between these surfaces. For example, at least one of these surfaces may be constructed from a material that provides at least a minimum threshold coefficient of friction between the surfaces. As another alternative, one or more of the surfaces may be smoothed or roughened to increase the coefficient of friction. As still another example, one or more of the surfaces may be treated with a composition (such as an adhesive) that increases the coefficient of friction between the surfaces and/or removably holds them together. Other coefficient of friction increasing treatments or materials may be used without departing from the invention.

The coefficient of friction between these surfaces (i.e., the outsole and midsole major surfaces), at a minimum, in at least some instances, will be greater than a coefficient of friction between the outsole surface and the ground surface on which it is typically used. Desirably, in at least some examples, the outsole member will move or slide with respect to the ground surface before it will move or slide substantially with respect to the midsole member.

Additional aspects of this invention relate to footwear systems. At least one example of such footwear systems includes a pair of shoe bases (e.g., upper members and midsoles, for example, fixedly engaged with one another like those described above) and multiple pairs of removable outsole members, e.g., like those described above. The removable outsole members may be freely engaged with and disengaged from the shoe bases, depending on various factors, such as user preference, weather conditions, ground surface conditions, temperature conditions, humidity conditions, and the like. If desired, one pair of outsole members may be designed for use on one type of ground surface (e.g., a hardcourt tennis court surface) and/or under one set of conditions (e.g., wet or cold conditions), while another pair may be designed for use on a different type of ground surface (e.g., a clay court surface, a grass court surface, or the like) and/or under a different set of conditions (e.g., dry or hot conditions). Alternatively, if desired, more than one pair of the outsole members may be designed for use on the same type of ground surface, e.g., such that a second pair of outsole members is available to replace the first pair when the first pair becomes worn or otherwise unusable. More than two pair of outsole members may be included in the system, if desired.

Another example footwear system in accordance with aspects of this invention may include a pair of shoe bases (e.g., upper members and midsole members fixedly engaged with one another, for example, like those described above) and a pair of removable outsole members, e.g., like those described above. Rather than (or in addition to) providing multiple pairs of outsole members, the footwear system in accordance with this aspect of the invention includes means for obtaining an additional pair of outsole members to substitute for the initial pair of outsole members. Optionally, the additional pair of outsole members may be specially designed for use on the same type of ground surface, on another type of ground surface, under the same use conditions, under different use conditions, etc., without departing from the invention.

Various means for obtaining the additional pair of outsole members may be used in accordance with at least some examples of this invention. For example, this "means" may include a coupon redeemable for a free or discounted pair of outsole members, e.g., redeemable through a mail-in system, over a computer network (such as the Internet), at a point of sale location (e.g., a retail store, etc.), and the like. As another example, the means for obtaining the additional pair of outsole members may include a code or other information that may be entered through a computer network that results in dispatch of a free or discounted pair of outsole members to the user, e.g., through the mail to a user's home, to a retail location, etc. Other systems and methods of providing the additional pair of outsole members may be used without departing from this invention.

Additional aspects of this invention relate to methods of using footwear systems including the footwear systems described above. As a more specific example, methods in accordance with this invention may include: (a) determining a type of surface or play condition(s) under which an event will take place; (b) selecting a pair of outsole members, at least in part, based on the type of surface or play condition(s); and (c) removably attaching the pair of outsole members to a pair of shoe base members. Methods according to aspects of the invention further may include: performing the event wearing a pair of shoes including the pair of shoe base members with the pair of outsole members attached thereto.

Methods according to examples of the invention further may include determining at least one additional condition at a location at which the event will be performed, wherein the step of selecting the outsole member takes this additionally determined condition into account. Any suitable or desired condition(s) may be considered in determining which outsole member to select, such as: ambient air temperature, surface temperature, predicted high ambient air temperature during performance of the event, predicted low ambient air temperature during performance of the event, predicted high surface temperature during performance of the event, predicted low surface temperature during performance of the event, ambient humidity, presence or absence of precipitation, and predicted presence or absence of precipitation. If desired, the footwear system may be marketed with selection aids available to the user, retailer, etc., such as a "look-up" table, a movable slide rule or wheel, a computer program, or the like, into which one or more ground surface types and/or conditions may be entered, and the selection aid provides a recommended outsole member design or construction based on the input parameter(s).

During performance of an event, or between two independent events, such as athletic events, the footwear system user may remove the previously or initially selected pair of outsole members from the pair of shoe base members, removably attach a new pair of outsole members to the pair of shoe base members, and resume performing (including starting a performance of a new event) wearing the pair of shoe base members with the new pair of outsole members attached thereto. Optionally, in at least some instances, the outsole member pair may be changed to accommodate a new type of play surface, changing conditions, user choice, excessive wear or failure of the existing outsole members, etc.

At least some examples of this invention may be specifically directed to footwear used in playing tennis, wherein the type of tennis court surface, at least in part, may dictate the type of outsole member selected. For example, a player may use different outsole members on hardcourt surfaces, clay court surfaces, grass surfaces, asphalt surfaces, concrete surfaces, etc. Other ambient and/or local conditions, as described above, also may be used in selection of outsole members for use in a specific match. Of course, upper members, shoe base members, and/or outsole structures may be provided for uses other than tennis, as suitable upper members, shoe base members, and/or outsole members may be provided for a wide variety of uses, use conditions, surfaces, and the like. As one more specific example, running or jogging shoes may be provided with different upper members and/or outsole members for different uses and/or use conditions, e.g., depending on the event, the distance to be run, the event surface, weather or other ambient conditions, etc.

Specific examples of the invention are described in more detail below. The reader should understand that these specific examples are set forth merely to illustrate examples of the invention, and they should not be construed as limiting the invention.

C. SPECIFIC EXAMPLES OF THE INVENTION

The figures in this application illustrate various example removable outsole members, footwear products, systems, and methods in accordance with this invention. When the same reference number appears in more than one figure, that reference number is used consistently in this specification and the figures to refer to the same part or element throughout.

FIG. 1 illustrates an example footwear product 100 in accordance with an example of this invention. The footwear product 100 includes a footwear or shoe base portion 102 having a removable outsole member 104 removably attached thereto. The shoe base portion 102 includes an upper member 106 that has a midsole member 108 fixedly attached to it. Any means or method may be used to attach the midsole and upper members together, including conventional means and methods known in the art, for example: adhesives, cements, laser or ultrasonic binding, sewing, other mechanical connectors, and/or the like. The shoe upper member 106 further may include a closure system 110. While any desired closure system or combination of closure systems may be used without departing from the invention (such as buckles, zippers, hook-and-loop fasteners, straps, etc.), in the illustrated example the upper member 106 is closed and secured to a user's foot using a conventional shoe lace. Also, the shoe upper members 106 and midsole members 108 may be made of any desired materials, including natural or synthetic materials or combinations thereof, including conventional materials known in the art.

In the example footwear product 100 illustrated in FIG. 1, the outsole member 104 completely covers an exterior major surface of the midsole member 108. Notably, the removable outsole member 104 has an exterior major surface 112 made of a material, construction, and/or design (e.g., sufficiently wear-resistant, with suitable tread design, etc.) such that it is suitable to directly contact the ground during use of the footwear product 100 (e.g., suitable for performance use). The exterior major surface of the midsole member 108, on the other hand, may be of a material, construction, and/or design such that, on its own, it may not be suitable for directly contacting the ground surface during performance use (e.g., in some examples, the midsole member 108 may quickly wear out; it may not provide suitable traction or tread; it may provide inadequate contact with the ground (e.g., on one or more slender raised ribs); it may puncture or provide inadequate support; etc.), if used in a prolonged manner during play of an event in direct contact with the ground or other play surface).

The outsole member 104 may be attached to the shoe base portion 102 in any suitable or desired manner without departing from the invention. For example, in the illustrated embodiment, the outsole member 104 wraps around and/or at least partially contains the base portion 102 (e.g., extends over and around the toe area of the upper member), and in this manner holds the two members together. This structure, in at least some instances, may be sufficient to hold the members together. The illustrated example, however, further includes a mechanical attachment point at the heel area of the combined shoe/outsole structure. Specifically, in this example, the outsole member 104 includes a "loop" or tab type arrangement 120 that provides a handle to help pull the outsole member 104 around and onto the shoe base portion 102. If desired, the tab arrangement 120 also may pull over and engage a "hook" or ridge type arrangement 122 (or other retaining structure) provided (e.g., integrally molded) in the midsole member 108, in a heel counter of the upper member 106, etc. Alternatively, the outsole member 104 may include a hook type device that engages an opening or retaining member provided in the midsole member 108, the upper member, or other portion of the shoe base structure 102. Additional and/or other mechanical engaging elements may be provided between the outsole member 104 and the shoe base portion 102 if desired, without departing from the invention. At least some of these engagement systems will be described in more detail below.

The removable outsole member 104 of this example further includes an upper containing region 114. As illustrated in FIG. 1, the upper containing region 114 extends at least partially around the upper member 106 to thereby contain at least a portion of the upper member 106. This upper containing region 114 helps secure the removable outsole member 104 to the shoe base portion 102 and helps maintain it securely in place during use, as will be described in more detail below. Notably, in this illustrated example, the upper containing region 114 is made from a flexible material (e.g., an elastomeric or polymeric material) such that it flexes, bends, and changes shape based on movement and/or shape changes of the underlying upper member 106. Additionally, in the illustrated example, the upper containing region 114 at least partially extends over, contains, or covers the closure system 110 (e.g., in the illustrated example, the upper containing region 114 extends over the bottom portion of the shoe lace 110).

The upper containing region 114 need not completely enclose and contain the entire footwear closure system 110, the upper member 106, and/or the midsole member 108. Rather, as illustrated in FIG. 1, the midsole member 108 may, at least in part, extend outside of the outsole member 104 (e.g., in the side and heel areas in the illustrated example). Additionally, the outsole member 104 may have an "open" construction such that some portions of the closure system 110, the upper member 106, and/or the midsole member 108 appear through or extend outside of the outsole member 104. This type of "open" construction helps reduce the overall weight of the outsole member 104 and the entire footwear product 100 without adversely impacting the strength of the outsole member 104 and/or its attachability to the shoe base 102. These "open" areas also may be provided with appropriate shapes and at appropriate locations to enhance the flexibility of the outsole member 104, to prevent excessive reduction in the flexibility of the shoe base 102, to encourage the outsole member 104 to move with the upper member 106, to maintain the position of the upper member 106 with respect to the outsole member 104 (e.g., to maintain the coefficient of friction), etc.

In some examples, if desired, the exterior major surface of the midsole member 108 may include at least some portion (e.g., a minor portion) made of a material, construction, or design suitable for direct contact with the ground surface during performance use. In such an example, the removable outsole member 104 may cover only a substantial (or major) portion of the exterior major surface of the midsole member 108 (leaving the portion of the midsole member 108 suitable for direct contact with the ground exposed and available to contact the ground). As examples, the heel area of a midsole member 108 or a toe area of a midsole member 108 may be constructed in a manner suitable for direct contact with the ground. As other examples, however, the outsole member 104 may completely cover the exterior major surface of the midsole member 108. Also, if desired, the outsole member 104 may include multiple individual pieces that, when combined on a shoe base 102 for use, cover all or a major portion of the major exterior surface of the midsole member 108.

Even when the exterior major surface of the midsole member 108 is not designed for contact with the ground during performance use, it still may have sufficient strength, durability, support, and/or wear resistance to enable at least some direct contact with the ground surface. For example, the exterior major surface of such midsole members 108 may have sufficient strength, support, wear resistance, and durability to allow a user to walk around, at least some, on the midsole member's exterior surface while not performing an event, e.g., while changing outsoles, in the locker room, indoors, or the like. At least some direct contact with the ground is envisioned, even for midsole members that are not designed for performance use in direct contact with the ground.

Figure 2:
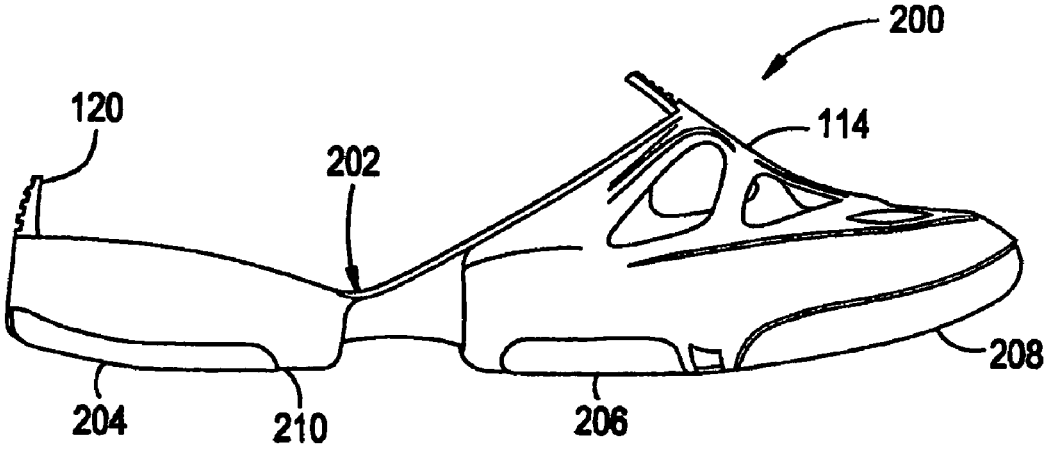
FIGS. 2-4 illustrate an example outsole member useful in example structures and methods in accordance with the invention.
Figure 3:
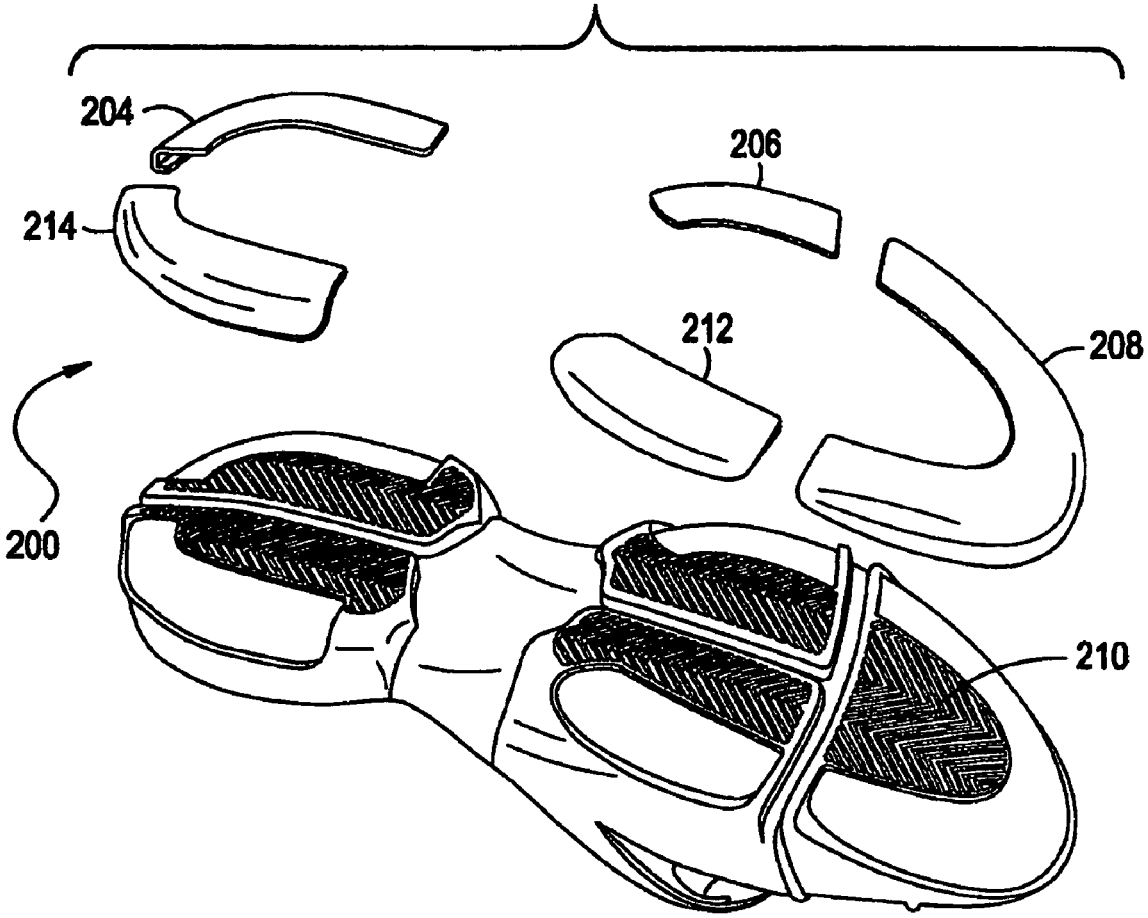
Figure 4:
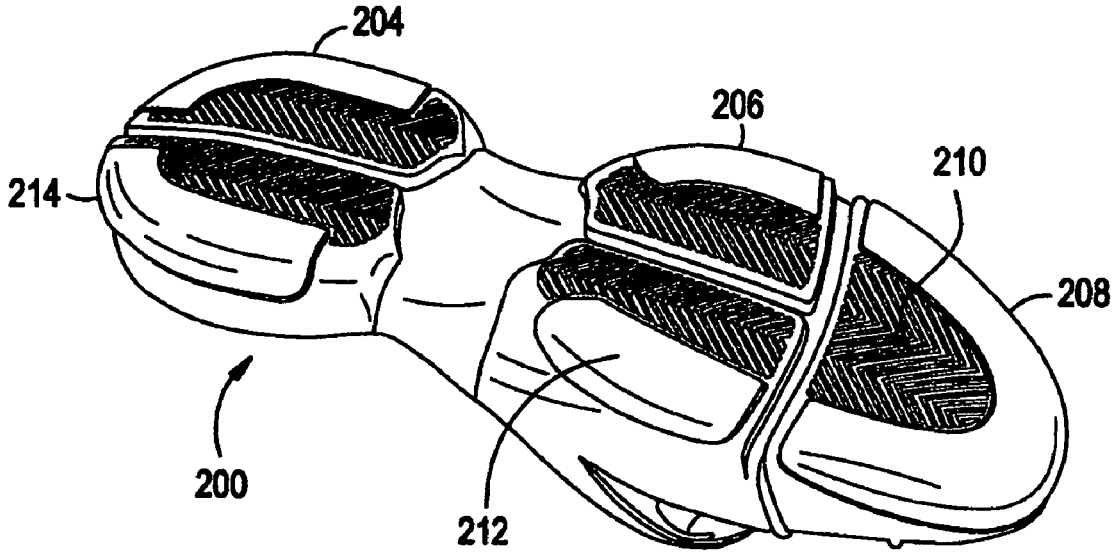

FIGS. 2-4 illustrate another example of a removable outsole member 200 in accordance with another example of this invention. The size, shape, and construction of this example outsole member 200 are similar to those illustrated in the example of FIG. 1, including an upper containing region 114 designed to contain, at least in part, the midsole member, the upper member, and the closure system of a shoe. An interior major surface 202 of the outsole member 200 is designed to engage and cover at least a major portion of the exterior major surface of a complementary midsole member of a shoe base portion as described above in conjunction with FIG. 1.

The example outsole member 200 of FIGS. 2-4 differs from the outsole member 104 in FIG. 1 in that the outsole member 200 of FIGS. 2-4 includes outsole attachment elements 204, 206, 208, 212, and 214. These outsole attachment elements 204, 206, 208, 212, and 214 may be attached to the outsole member 200 (e.g., to its exterior major surface 210) in any desired manner without departing from the invention, such as via cements, adhesives, laser or ultrasonic binding, sewing, other mechanical connectors, and/or the like. As additional examples, these attachment elements 204, 206, 208, 212, and 214 may be fixedly or removably attached to the outsole member 200 (e.g., to its exterior major surface 210 and/or its side surfaces) without departing from the invention. Furthermore, these attachment elements 204, 206, 208, 212, and 214 may perform any desired function without departing from the invention. For example, they may provide additional wear-resistance in selected areas of the outsole member 200, they may provide different tread designs or characteristics at selected areas of the outsole member 200, they may provide a different aesthetic appearance, they may provide logo or indicia display panels or areas, and/or etc. In the illustrated example, five independent attachment elements are shown, namely a lateral heel attachment element 204, a lateral side attachment element 206, a toe attachment element 208, a medial side attachment element 212, and a medial heel attachment element 214. Of course, any number of attachment elements may be included with a final outsole member design without departing from the invention. For example, the toe attachment element 208 may be made from two or more separate pieces (e.g., medial and lateral) and/or the two heel attachment elements 204 and 214 could be constructed from a single piece without departing from the invention. If desired, one attachment element could cover all or substantially all of the outsole member 200 perimeter. Additionally, or alternatively, one or more of the illustrated attachment elements 204, 206, 208, 212, and 214 may be omitted from the outsole member 200 structure without departing from the invention.

One or more of the outsole attachment elements 204, 206, 208, 212, and 214, along with the underlying outsole member base 200, may function as a "wear indicator." For example, by making the outsole member base 200 a different color (e.g., a contrasting color) from the outsole attachment elements 204, 206, 208, 212, and/or 214, excessive wear of the outsole attachment elements 204, 206, 208, 212, and/or 214 may be noted when the color of the outsole base member 200 appears through one or more of the outsole attachment elements. This color change or appearance may be used as a visual cue to advise the user that the time has come to change outsole members 200 (or at least attachment elements 204, 206, 208, 212, and 214).

As another example for producing a wear indicator, the wear indicator may constitute a compression molded rubber layer of contrasting color that is molded into the outsole member 200 structure (at least at some locations) at the same time that the remainder of the outsole member 200 is formed. For example, a rubber layer approximately 0.5 to 1.5 mm thick (or thicker) of contrasting color may be laid into a conventional mold in at least some places between (a) the rubber material for the exterior surface of the outsole member (e.g., approximately 1 to 3 mm thick), (b) an optional interior plastic wall (e.g., approximately 1 to 1.5 mm thick) which may help the outsole member hold its structure, and (c) the mold surface. This combination then may be pressed together in a compression molding process such that the wear-resistant material forms the outer surface of the outsole member 200 and the wear indicator layer is located away from the play surface (optionally sandwiched between the outer surface and the interior plastic wall). After and as a result of use, when the athlete sees the contrasting color of the wear indicator layer through the exterior layer of the outsole member, this will be a visual cue to indicate that it is time to replace the outsole member shell before potential outsole member failure occurs and/or damage to the midsole unit occurs (e.g., as may occur if the wall thickness of the plastic shell behind the wear indicator is breached and wear on the midsole occurs).

With footwear products including removable outsole members in accordance with at least some examples of the invention, users can freely change the outsole member, e.g., when it becomes worn, when playing or practicing on a different ground surface, when weather or other play conditions change, for aesthetic preference reasons, etc. For example, as noted above, playing tennis or other activities on hardcourt surfaces can quickly deteriorate shoe outsoles such that the outsoles often wear out before the upper member, midsole member, insole, and/or other portions of the footwear. Accordingly, when a piece of footwear is equipped with a removable outsole member in accordance with aspects of this invention, an existing outsole member can be removed and replaced with a new one, typically at a reduced cost compared to the cost of a new pair of shoes, thereby effectively extending the life of the footwear product and reducing costs associated with participating in the event.

Figure 5A:
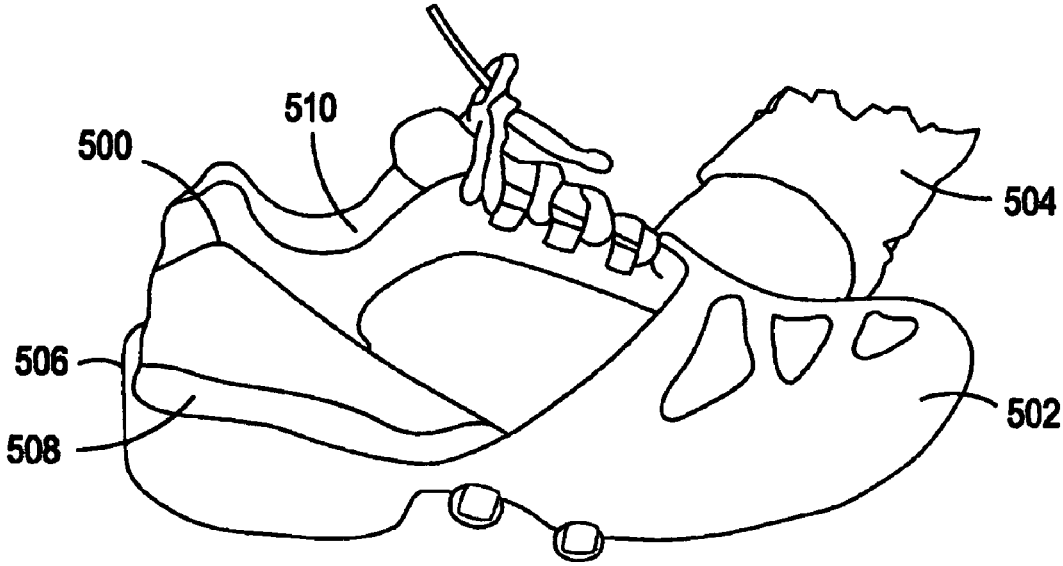
FIGS. 5A through 5D illustrate an example outsole removal and/or attachment procedure in accordance with examples of this invention.

FIGS. 5A through 5D illustrate an example outsole member removal/attachment procedure. As illustrated in FIG. 5A, the removal procedure begins with a shoe base portion 500 having a removable outsole member 502 attached thereto. While the shoe base portion 500 and outsole member 502 can have any desired construction or appearance, the illustrated example has an appearance generally like that illustrated in FIG. 1. Because the outsole member 502 is excessively worn and/or not of optimal structure for use in an upcoming or presently active event (or for any other reason), the user 504 decides to change outsole members 502.

Figure 5B:
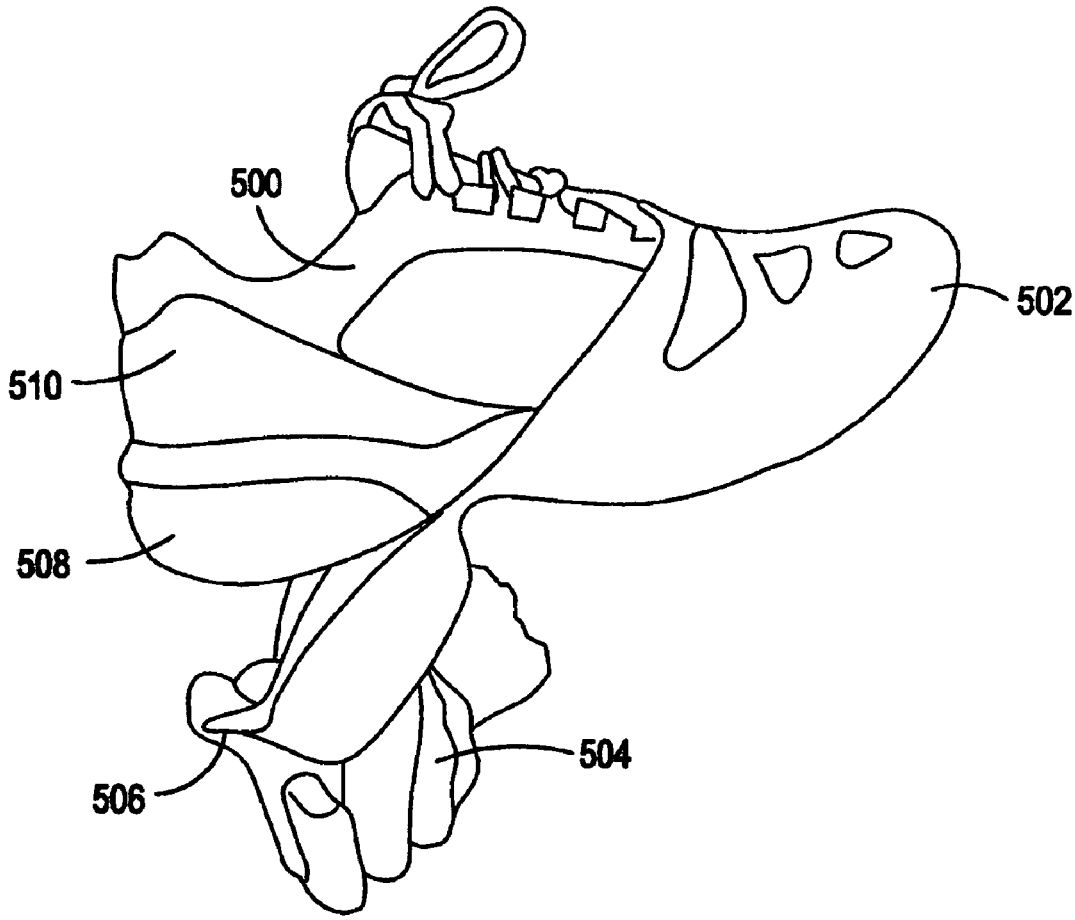

To remove the outsole member 502 from the shoe base portion 500, the user 504 first pulls a heel tab 506 to disengage it from a corresponding slot, opening, or other retaining structure provided in the heel area of the midsole member 508, the upper member 510, and/or another portion of the shoe structure (e.g., a heel counter, etc.), as shown in FIG. 5B. The heel tab 506 may include a snap, raised ledge or rib, mechanical connector, or other suitable structure that engages a corresponding engagement element on the midsole member 508, the upper member 510, and/or another portion of the shoe structure (such as a heel counter, etc.). If desired, any additional type(s) of connection between the outsole member 502 and the remainder of the shoe base portion 500 may be provided (and disengaged) without departing from the invention. For example, one or more tabs, clips, or other mechanical connectors may be provided on or as part of the outsole member 502 (e.g., in the heel area and/or along the lateral and/or medial sides) that engage with corresponding engagement elements, openings, retaining structures, or the like provided in the midsole member 508, the upper member 500, and/or another portion of the shoe structure (e.g., a heel counter, etc.). As another example, if desired, a weak adhesive or a shear-resistant adhesive may be applied to the exterior major surface of the midsole member 508 and/or to the interior major surface of the outsole member 502 to help hold these elements together and in place with respect to one another. As still another example, and as will be described in more detail below, mechanical and/or static engagement elements may be provided in the exterior major surface of the midsole member 508 and/or in the interior major surface of the outsole member 502 to help hold these elements together and in place with respect to one another. For example, one or more raised ribs and corresponding mating grooves may be provided in the exterior major surface of the midsole member 508 and/or the interior major surface of the outsole member 502. These ribs and their corresponding mating grooves may engage one another to help hold the midsole and outsole members together and in place with respect to one another. The rib and groove structures may be arranged to prevent both longitudinal and lateral movement of the midsole and outsole members with respect to one another.

If desired, the attachment means may provide an indication to confirm for the user 504 that the outsole member 502 is properly oriented and seated with respect to the remainder of the shoe base structure 500. For example, an audible or visual indicator may be provided to confirm proper installation of the outsole member 502. In the illustrated example, as shown in FIG. 5A, the heel tab 506 may include a ridge that moves over and fits into a groove or opening provided in the upper member 510, the midsole member 508, and/or some other portion of the shoe base 500 such that the tab 506 lays flat against the upper member 510 when properly installed but juts away somewhat from the upper member 510 when not properly oriented. Additionally or alternatively, the ridge on the heel tab 506 (or another structure) could provide an audible sound or "click" when it properly slides over and into its receiving groove or opening. As another example, raised pegs or ridges on the midsole member 508 (or another portion of the shoe base 500) may fit into grooves and/or openings provided in the outsole member 502, to provide audible and/or visual placement confirmation. As yet another example, color from the midsole appearing through openings provided in the outsole member 502 may provide a visual indicator of correct orientation or placement. Of course, other ways of providing audible and/or visual confirmation of proper outsole installation and orientation may be used without departing from the invention.

Figure 5C:
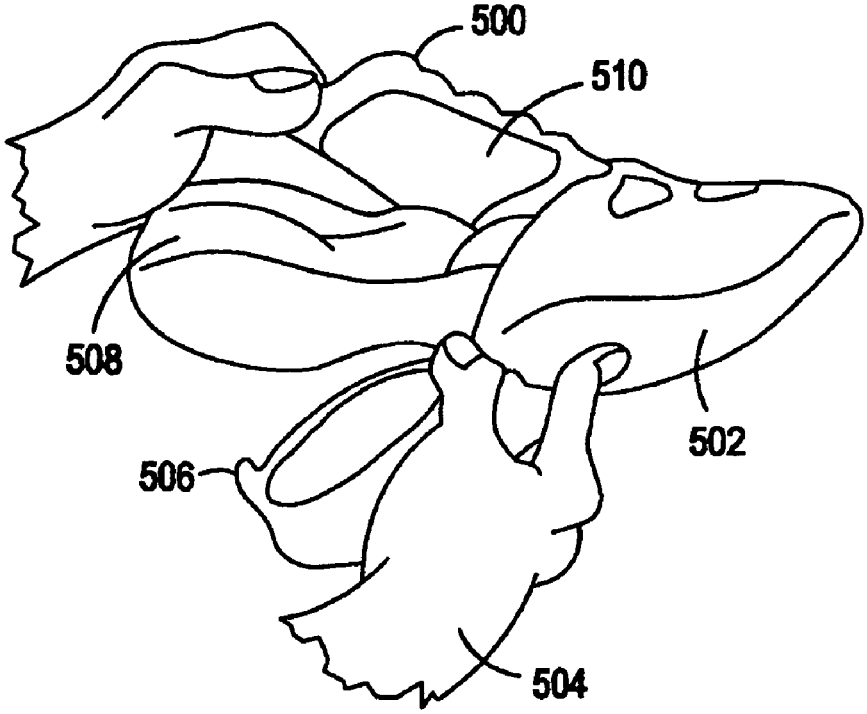
Figure 5D:
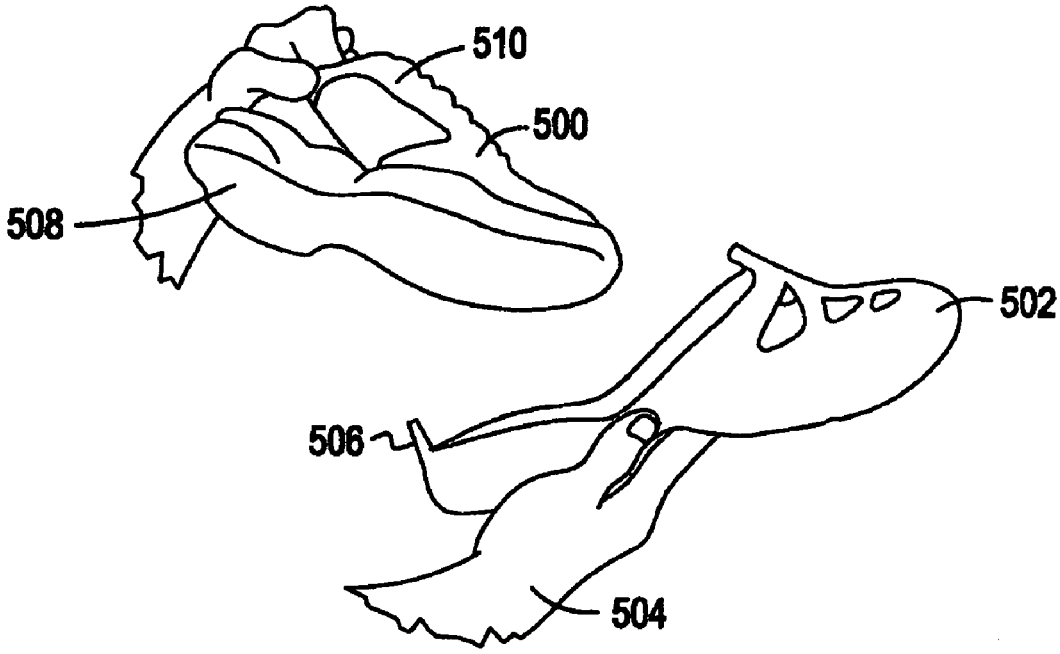

Returning to the illustrated example method, once the heel area of the midsole member 508 is out of the outsole member 502 (as shown in FIG. 5B), the user 504 then pulls the toe portions of the midsole member 508 and the upper member 510 from the outsole member 502, as illustrated in FIGS. 5C and 5D. In at least some examples of the invention, at least a portion of the outsole member 502 may be attached to the upper member 510, e.g., through the closure system of the footwear (e.g., by lacing the shoe lace of the footwear through corresponding openings provided in the outsole portion, by lacing a strap through openings provided in the upper receiving portion of the outsole member 502, by hook-and-loop fasteners, and/or by another mechanical connection). Therefore, if necessary, before performing these steps, any attachment between the outsole member 502 and the upper member 510 should be disengaged (e.g., by unlacing the shoe and/or disengaging any other mechanical connections).

To place a new outsole member 502 on the footwear base portion 500, the procedures described above and illustrated in FIGS. 5A through 5D may be reversed. For example, the toe area of the upper member 510 and the midsole member 508 may be placed in the outsole member 502 (optionally after applying an adhesive or other coefficient of friction increasing composition into the outsole member 502 or onto the midsole member 508, if desired), and optionally, the closure system (e.g., the shoe lace) of the footwear base portion 500 may be attached to the outsole member 502, if appropriate. Then the heel portion of the outsole member 502 may be stretched around the heel portion of the midsole member 508 so that the tab, clip, or other mechanical connector(s) 506 may engage corresponding connection element(s) (e.g., grooves, openings, raised ribs, etc.) provided in the midsole member 508, upper member 500, and/or other portion of the footwear structure. An audible click and/or visual indicator may confirm proper arrangement of the new outsole member 502 on the footwear base portion 500, as described above.

If desired, temperature or other suitable treatments (e.g., application of heat, cold, humidity, steam, water, etc.) may be used during the outsole member removal and/or application processes, if such steps will help more easily apply and/or remove the outsole member 502 to/from the remainder of the shoe base structure 500. For example, when outsole members 502 are molded at or substantially at the same size as the midsole members 508 to which they will be stretched over and fitted (e.g., to provide a tight fit), application of heat to the outsole member 502 (e.g., using a portable hair dryer) may help make it easier to stretch and fit the outsole member 502 over the corresponding midsole member 508, both from a material pliability or elasticity standpoint and/or a material coefficient of expansion standpoint. Once applied, however, commonly sized (or substantially commonly sized) outsole members 502 and midsole members 508 will tightly fit and stay together, e.g., during performance or athletic use, particularly when one or more of the additional attachment and/or engagement systems described herein are used in combination with the tight fit.

Figure 6:
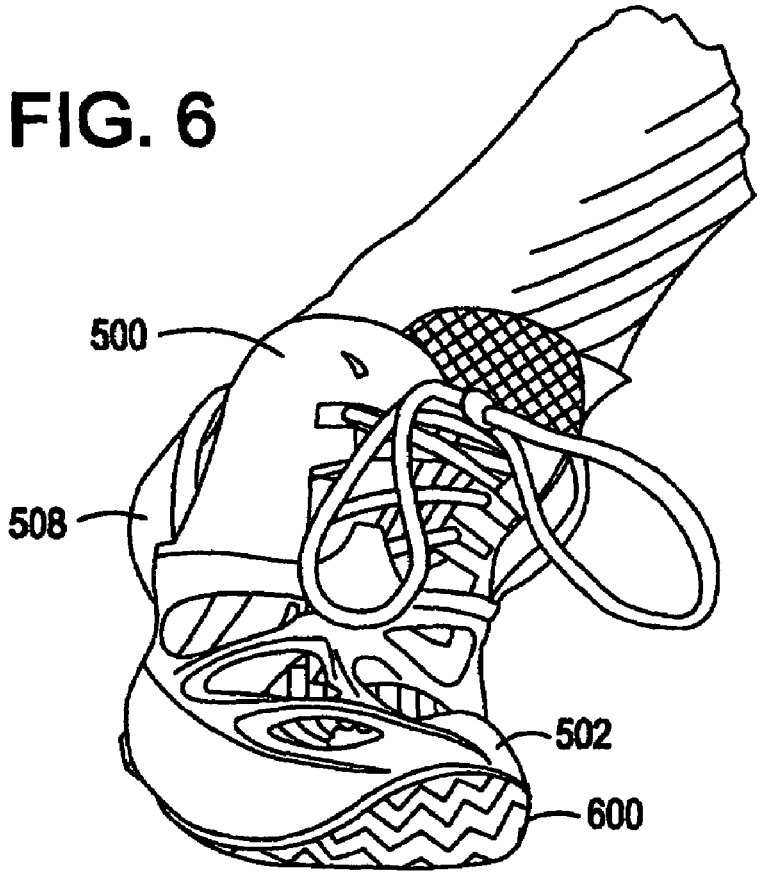
FIG. 6 illustrates an ultimate end use of an example footwear system in accordance with this invention.

In performance or athletic use (e.g., use of the footwear for its intended purpose), as illustrated in FIG. 6, the outsole member 502 remains stationary or substantially stationary with respect to the upper member 500 and/or the midsole member 508. Preferably, when in performance use, the outsole member 502 will not slide, move, or bunch up with respect to the midsole member 508. As described above, various mechanical features of the footwear structure, adhesives, and/or other features may be used to help maintain the relative position of the exterior major surface of the midsole member 508 with respect to the interior major surface of the outsole member 502. Additionally, the material(s) and/or surface characteristic(s) of the midsole member 508 and/or the outsole member 502 may further help maintain their relative positions. For example, use of somewhat soft, elastomeric material(s) and/or somewhat textured surface material(s) for the exterior major surface of the midsole member 508 and/or the interior major surface of the outsole member 502 may help increase the coefficient of friction between these surfaces and help them maintain their relative positions. In at least some examples, the coefficient of friction between these major surfaces will be greater than the anticipated coefficient of friction between the ground surface and the outsole member.

As some more specific examples, for tennis (and/or other activities), the coefficient of friction between a court surface and the bottom of a standard rubber outsole typically may be at least about 1.0. Therefore, to achieve a stable engagement between a removable outsole member and a midsole member to which it is attached (e.g., during an extreme lateral cutting maneuver or a quick direction change maneuver), the coefficient of friction between the outsole member and the midsole member in at least some examples of the invention will be sufficiently large so that the outsole's major exterior surface breaks direct contact with the ground surface (e.g., it slides on the ground, etc.) before the outsole member begins to rotate on the midsole member. In some examples in accordance with the invention, as will be shown below, the dynamic coefficient of friction between the midsole member's major exterior surface and the outsole member's major interior surface will be greater than 1.0, even greater than 1.2, and in some examples, greater than 1.4 or even greater than 1.5.

As noted above, friction between the outsole member and the midsole member (or other portion of the footwear structure) may be used, at least in part, to firmly hold these members in place with respect to one another. A wide variety of materials may be used for both the midsole member and the outsole member in footwear products with removable outsole members, like the products described above, provided that the materials can be securely attached to one another in use to prevent undesired slipping, bunching, or other failure. Nonetheless, the outsole member must remain relatively easily removable, to enable user to change outsole members, when necessary and/or desired.

One measure of the ability for two materials to hold to one another relates to the "coefficient of friction" ("COF") observed when the two materials are pressed together and an attempt is made to move or slide one of the materials with respect to the other (e.g., via a translational force). Below are COF measurement test results for various combinations of material types that may be used in footwear midsole materials and removable outsole members in accordance with examples of this invention. Specifically, the "dynamic coefficient of friction" ("DCOF") between various foam materials (e.g., midsole materials) and various injection molded thermoplastics (e.g., outsole materials) was measured. The midsole foam materials tested included PU (LU/FO 001) (a polyurethane foam material available from Coim S.p.A.), CMP Phylon (MWE-024) (an ethylene vinyl acetate low density starter foam available from various commercial suppliers), CMP Phylon (MWE-024) with a cast urethane bottom film or cover sheet (cast urethane film available from Kurim Corp.), and Phylite injection unitsole Phylon compound (material available from Dongsung Chemical) (e.g., a combination of Phylon (60%) and rubber (40%))). The thermoplastic materials tested were SK Chemical T470 TPU 70A (a polyester based thermoplastic urethane available from SK Chemical Co.), Bayer Desmopan® 9370 TPU 70A (a polyether based thermoplastic polyurethane material available from Bayer AG), and Kraiburg 8706-26 TPR 60A (a thermoplastic rubber available from Kraiburg, also called "KHTP 8706-26" herein).

COF testing was conducted in accordance with the Sporting Goods Manufacturers Association ("SGMA") voluntary standard for football glove COF developed for the NCAA and the National High School Federation. Specifically, a 1 inch by 2.4 inch strip of the thermoplastic material was pressed against the foam material using a 198 gram sled. The sled was then pulled at a rate of 100 mm/min (the translational force), and the force required to move the thermoplastic material with respect to the foam material was measured. The units of the measurements described in the table below are the maximum translational force required divided by the downward or normal force applied. In the testing described below, no specific smoothing or texturing was applied to the surfaces of the materials tested. Likewise, no post-molding treatments were introduced.

TABLE 1

Average Dynamic Coefficient of Friction Values with Standard Deviations in Parentheses

| | SK Chemical T470 TPU 70A | Bayer Desmopan ® 9370 TPU 70A | Kraiburg 8706-26 TPR 60A |
|---|---|---|---|
| PU (LU/FO 001) | 1.06 (0.02) | 0.84 (0.02) | 1.22 (0.16) |
| CMP Phylon (MWE-024) | 1.11 (0.01) | 0.61 (0.04) | 0.78 (0.17) |
| CMP Phylon (MWE-024) w/Cast Urethane Bottom | 0.75 (0.01) | 0.74 (0.03) | 1.09 (0.04) |
| Phylite | 1.57 (0.15) | 1.48 (0.06) | 2.10 (0.07) |

As shown from the test results above, the Phylite foam exhibited significantly higher DCOF values than those observed when the same thermoplastics were tested on the other foams.

Another feature that appeared from these test results relates to the fact that when some combinations of thermoplastics and foams were being tested, there were very high levels of stick/slip. The process of stick/slip occurs when there are high enough frictional forces between the two materials to cause the material that is being dragged to slow down or stop, which is then recorded as increasing loads on the load cell, then eventually the force reaches a critical level at which the material breaks free and moves very quickly across the surface to catch up, the speed then returns to the normal 100 mm/min until it catches or sticks again. This feature causes a very jagged load vs. displacement curve. In order to get a general idea of how much stick/slip was actually seen in some of these material combinations, the minimum load was subtracted from the maximum load read between 50 mm and 150 mm of displacement, and this value is listed in Table 2.

TABLE 2

Differences Between Maximum and Minimum Load Values Between 50 mm and 150 mm

| | SK Chemical T470 TPU 70A | Bayer Desmopan ® 9370 TPU 70A | Kraiburg KHTP 8706-26 TPR 60A |
|---|---|---|---|
| PU (LU/FO 001) | 0.14 | 0.08 | 0 |
| CMP Phylon (MWE-024) | 0.11 | 0.06 | 0.04 |

Additionally, the resiliency of various outsole member materials was tested. Specifically, outsole members made of four different grades of resin material were tested, namely: A) Desmopan® 8785 (a thermoplastic polyurethane material available from Bayer AG); B) Desmopan® 9370; C) TPU T470; and D) KHTP 8706-26. The test method used included a dynamic frequency sweep in torsion rectangular mode on an ARES Shear Rheometer. The strain used was 1%, and the frequency range used was 0.1 radians per second to 100 radians per second sampling 5 times per decade of log frequency. The output from the test was given as storage modulus (G') and loss modulus (G") as a function of frequency.

TABLE 3

Test Setup:

| | |
|---|---|
| Strain | 1% |
| Temperature | 20° C. |

TABLE 3-continued

| Test Setup: | |
|---|---|
| Initial Frequency | 100 radians per second |
| Final Frequency | 0.1 radians per second |

The purpose of this test was to determine the most resilient of the four materials tested. The resiliency is determined by measuring the amount of energy dissipated as heat. A low energy dissipation is an indication that the material is resilient. To have a resilient material, the energy dissipated at the frequency at which the material will be used should be as low as practicable (in general, higher frequencies tend to correlate to impact resilience while lower frequencies tend to correspond more to static loading).

The frequency sweep on a sample taken from the outsole shell showed that the Desmopan® 9370 was the most resilient material followed by the T470 material at lower frequencies and KHTP 8706-26 higher frequencies. The outsole member made from the Desmopan® 8785 material generally had higher energy dissipation (and thus lower resilience) than the Desmopan® 9370 and T470 materials, particularly at the higher frequencies measured.

Advantageously, in use, as noted above, the outsole members 502 can be replaced one or more times on a given shoe base portion 500 because the user can still get useful life out of the upper member 510 and midsole member 508 structures (e.g., the footwear base portions 500 noted above) even after one or more sets of outsole members 502 wear out. In at least some examples of the invention, the outsole member 502 will be constructed of a suitable material to last for several play cycles, e.g., 20 hours or more of hard play or practice time on a hard, abrasive surface, preferably 25 hours or more or even 40 hours of more. In at least some examples, the exterior major surface 600 of the outsole member 502 (i.e., the surface in contact with the ground in performance use; see FIG. 6) will be of sufficient hardness, abrasion resistance, and/or strength to provide suitable wear and use characteristics for this time period. Any suitable or desired natural, synthetic, polymeric and/or elastomeric materials and/or combinations thereof may be used for the outsole member 502 without departing from the invention, including conventional outsole materials known in the art. The particular material chosen may depend, for example, on the desired wear, abrasion, and/or stretchability characteristics and/or the anticipated characteristics associated with an anticipated use (e.g., temperature, weather, precipitation, ground surface, and/or other conditions). As some more specific examples, in addition to the various materials described above, at least the exterior major surface 600 of the outsole member 502 may be constructed from: a thermoplastic rubber material having a 60 Shore A hardness, a polyether based thermoplastic urethane material having a 70 Shore A hardness, and a thermoplastic material having an 80 Shore A hardness.

In at least some examples of the invention, a user may choose to change outsole members 502 on a footwear base portion 500 for reasons other than excessive wear of the outsole members 502. For example, a user may attach different pairs of outsole members 502 to the shoe base portions 500 based on the type of surface on which play will take place. For example, individual users may play tennis on a variety of different court surfaces, including clay courts, grass courts, hardcourts, asphalt, concrete, etc., and different outsole members 502 may be selected for use at any given time, depending, at least in part, on the type of surface on which play will take place. In this way, a user can optimize the outsole surface to match a specific court surface.

Other or alternative factors also may be involved in the determination of which specific set of outsole members to use at a given time. For example, the conditions during play (e.g., actual or expected conditions) may be taken into consideration in determining which outsole member to select at a given time. Examples of such conditions may include: ambient air temperature, surface temperature, predicted high ambient air temperature during performance of the event, predicted low ambient air temperature during performance of the event, predicted high surface temperature during performance of the event, predicted low surface temperature during performance of the event, ambient humidity, presence of precipitation, predicted presence of precipitation, and the like. Because of the relatively simple outsole member change procedure involved in at least some examples of the invention, as described above in conjunction with FIGS. 5A through 5D, a user may, if desired, change outsole members during a break in play, during a time-out, between events, during a rain delay, and/or at any other desired time, e.g., if the ambient and/or surface conditions change and/or if it is determined that the originally selected outsole members are not optimum for the present conditions.

Figure 7A:
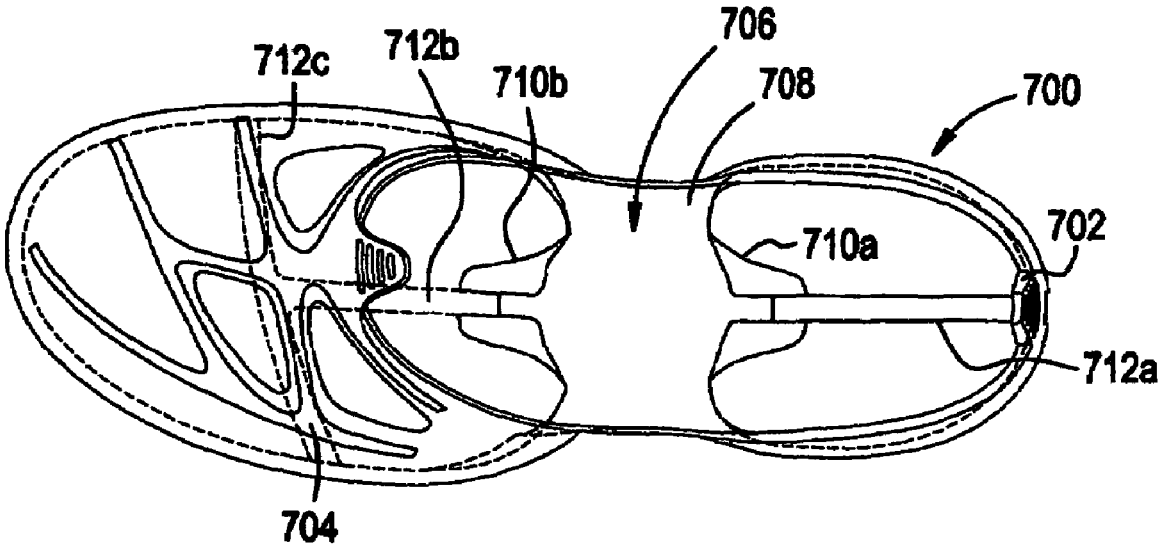
FIGS. 7A through 7D illustrate top, bottom, lateral, and medial views, respectively, of an example outsole member in accordance with this invention.

FIGS. 7A through 7J provide detailed views of an example outsole member 700 in accordance with this invention, and FIGS. 8A through 8J provide detailed views of an example midsole member 800 corresponding to this outsole member 700. In FIG. 7A, an overhead view of an example outsole member 700 is provided. From this view, one can see a heel tab 702 that fits into a corresponding groove, recess, or opening provided in a midsole member, an upper member, and/or another portion of the shoe structure as generally described above in conjunction with FIGS. 5A and 5B. An upper containing area 704 is provided at the front portion of the outsole member 700 to contain at least a portion of the upper member of the shoe structure. The heel tab 702 and upper containing area 704 help secure the outsole member 700 to the remainder of the shoe base structure.

The interior major surface 706 of this example outsole member 700 further includes a raised area 708 and two ramped areas 710*a* and 710*b*. These areas 708, 710*a*, and 710*b* fit into corresponding structures provided in the midsole structure as will be described in more detail below. Additionally, the interior major surface 706 of the outsole member 700 includes three raised rib areas 712*a*, 712*b*, and 712*c*, which also act as "engagement elements" to help engage the outsole member 700 with a midsole member. Any arrangement of raised areas and/or grooves on the interior major surface 706 of outsole member 700 may be used in combination with corresponding grooves and/or raised areas on the exterior major surface of the midsole member to help maintain these members in place with respect to one another without departing from the invention. Notably, in this illustrated example, raised rib area 712*a* is provided in the heel to mid-foot area and runs substantially in a longitudinal direction of the outsole member 700, raised rib area 712*b* is provided in the mid-foot to toe area and also runs substantially in a longitudinal direction of the outsole member 700, and raised rib area 712*c* is provided in the mid-foot to toe area and runs in a direction substantially transverse to the longitudinal direction of the outsole member 700. In this manner, raised ribs 712*a* and 712*b* help prevent lateral movement of the outsole member 700 with respect to a midsole, and raised rib 712*c* helps prevent longitudinal movement of the outsole member 700 with respect to a midsole. The ramped areas 710*a* and 710*b* and raised area 708 also help maintain the position of the outsole member 700 with respect to a midsole. Of course, any number of raised ribs, corresponding grooves, ramped areas, and/or other engagement elements of any size, shape, orientation, construction, or arrangement may be used without departing from the invention.

Figure 7B:
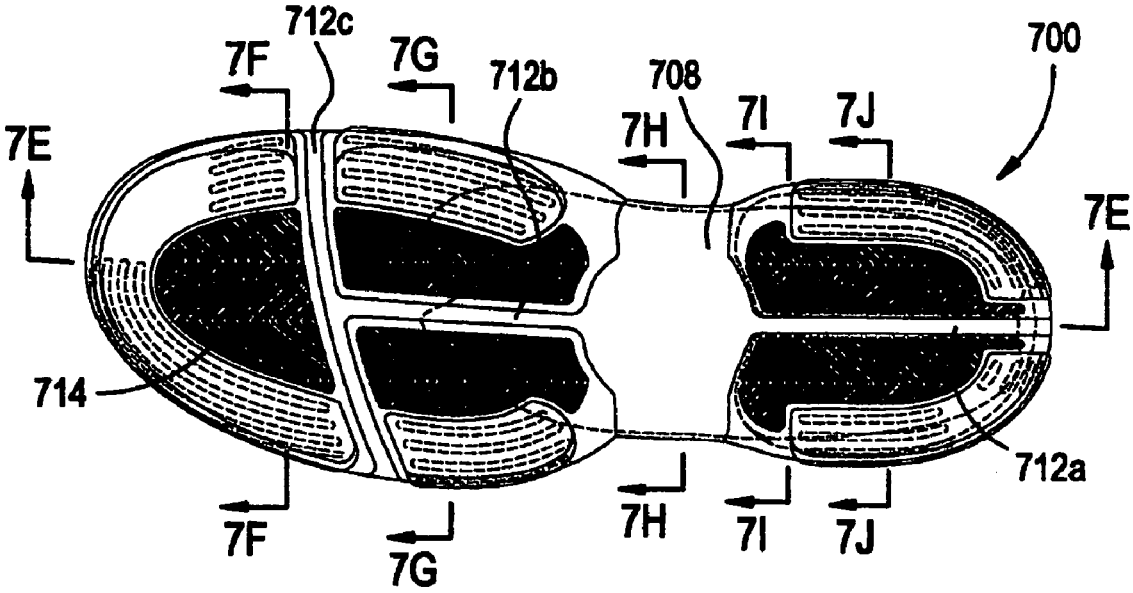

FIG. 7B illustrates a bottom view of the outsole structure 700 showing the exterior major surface 714 (designed with tread and made of a material suitable to directly contact the ground when the outsole member 700 is being used). Notably, in this structure, the raised ribs 712*a*, 712*b*, and 712*c* from FIG. 7A correspond to the similarly numbered grooved areas in the bottom surface 714 of FIG. 7B (although this is not required), and the raised area 708 also is shown (which corresponds to the location of the foot's arch).

Figure 7C:
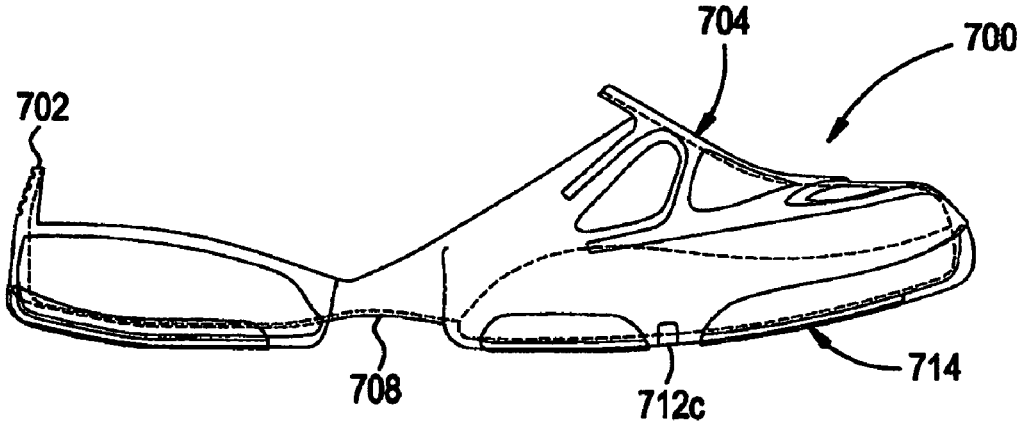
Figure 7D:
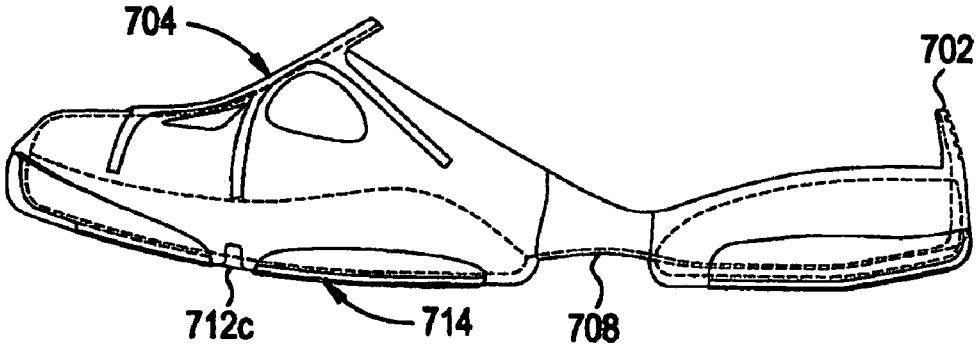
Figure 7E:
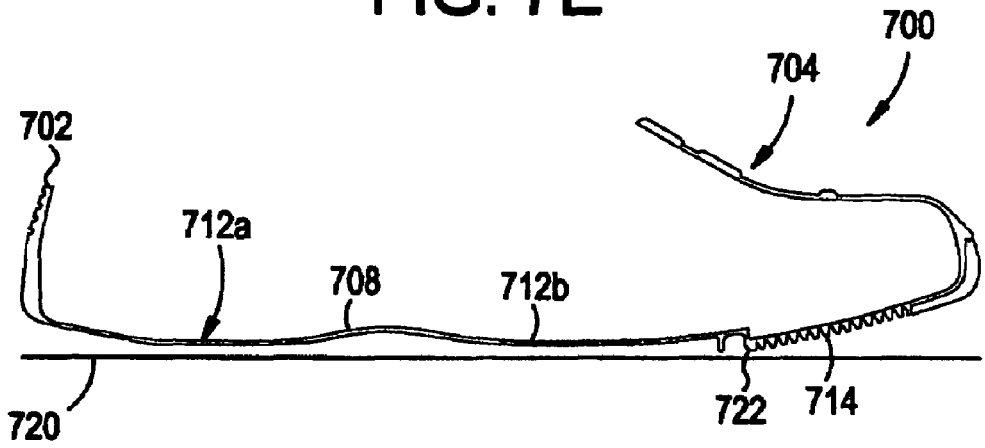
FIGS. 7E through 7J illustrate sectional views of the outsole member taken along lines 7E-7E, 7F-7F, 7G-7G, 7H-7H, 7I-7I, and 7J-7J, respectively, in FIG. 7B.

FIGS. 7C and 7D illustrate lateral and medial sides views, respectively, of the outsole member 700, with like parts from FIGS. 7A and 7B labeled with common reference numbers. FIG. 7E illustrates a sectional view taken along line 7E-7E in FIG. 7B. Notably, section line 7E-7E runs through the raised ribs 712*a* and 712*b*, thus lifting, the heel and mid-foot portions in FIG. 7E above the base line 720 until the tread area 722 reaches the toe/mid-foot area (just beyond raised rib 712*c*).

Figure 7F:
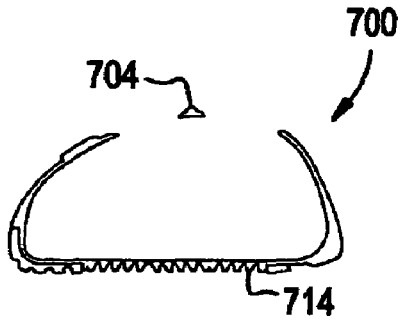
Figure 7G:
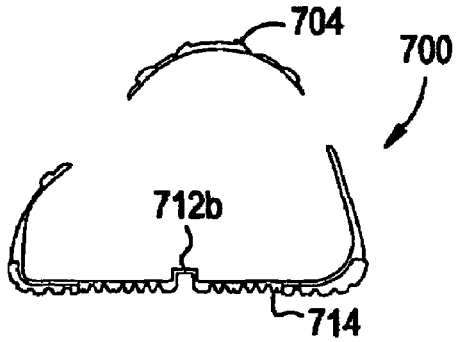

FIG. 7F is a sectional view taken along line 7F-7F in FIG. 7B. This drawing illustrates the exterior major surface 714 of the outsole member 700 (including its tread), as well as a small part of the upper containing portion 704. FIG. 7G is a sectional view taken along line 7G-7G in FIG. 7B. This drawing illustrates another portion of the exterior major surface 714 of the outsole member 700 as well as part of the upper containing portion 704 thereof. Additionally, raised rib 712*b* is visible in the sectional view of FIG. 7G.

Figure 7H:
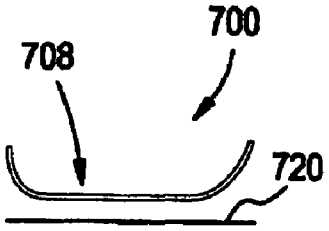
Figure 7I:
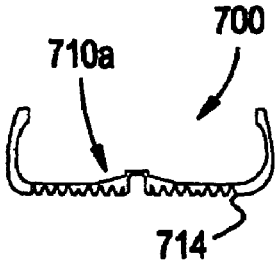
Figure 7J:
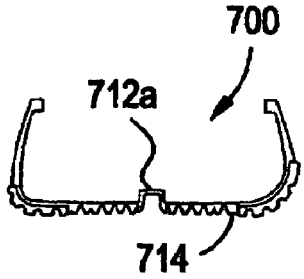

FIG. 7H is a sectional view taken along line 7H-7H in FIG. 7B. This drawing illustrates the raised portion 708 of the outsole member 700 (notably, the raised portion 708 is above the base line 720). FIGS. 7I and 7J are sectional views taken along lines 7I-7I and 7J-7J, respectively, in FIG. 7B. These drawings illustrate additional portions of the exterior major surface 714 of the outsole member 700, in the mid-foot and heel areas. Additionally, FIG. 7I illustrates the ramped area 710*a*, and FIG. 7J illustrates the raised rib 712*a* in the heel area of the outsole member 700.

The example outsole member 700 shown in FIGS. 7A through 7J (as well as the outsole member structures shown in other figures) has several open areas or windows defined in the portion of the outsole member that extends over and covers the shoe upper. Of course, any desired number of open areas or windows, or even no open areas or windows, may be provided without departing from this invention. The skilled artisan will be able to readily determine appropriate size, placement, and/or other characteristics of any desired open areas (e.g., to maintain adequate strength and/or wear resistance, to enable easy application or removal, to assure adequate outsole flexibility, etc.) through the use of routine experimentation. In some instances, one or more of the forward-most open areas (toward the toe of the shoe) in the example structures shown in FIGS. 1, 2, and 5A through 7J may be eliminated, and the resulting structure may, in at least some instances, provide longer play life, better strength, and/or better wear resistance. An example of such an outsole structure 900 is shown, for example, in FIG. 9, in which the forward-most open area (nearest to the toe) is eliminated as compared to the similar outsole member structures 104 and 200 shown in FIGS. 1 and 2, respectively.

As noted above, FIGS. 8A through 8J provide detailed views of an example midsole member 800 that may be used in combination with the example outsole member 700 illustrated in FIGS. 7A through 7J. This midsole member 800 may be attached to an upper member, e.g., using adhesives, cement, stitching, ultrasonic or laser welding, and/or other mechanical connectors, as described above.

Figure 8A:
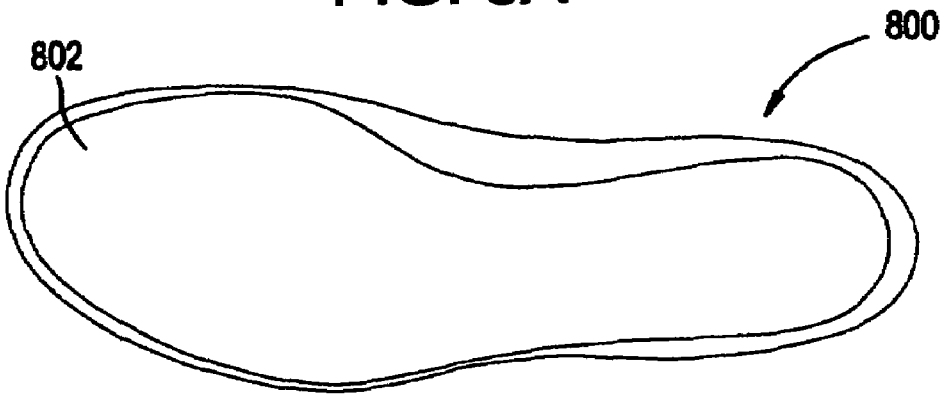
FIGS. 8A through 8D illustrate top, bottom, lateral, and medial views, respectively, of an example midsole member in accordance with this invention.

FIG. 8A illustrates an overhead view of an example midsole member 800. The interior major surface 802 of the midsole member 800 may include arch supports, impact attenuating elements, and/or other features, including conventional elements or features known in the art. As illustrated in the bottom view of the midsole member 800 shown in FIG. 8B, the exterior major surface 804 of the midsole member 800 includes an indented or raised area 808, two ramped areas 810*a* and 810*b*, and three grooved areas 812*a*, 812*b*, and 812*c*. These engagement element areas 808, 810*a*, 810*b*, 812*a*, 812*b*, and 812*c* receive and/or otherwise match up with the corresponding areas 708, 710*a*, 710*b*, 712*a*, 712*b*, and 712*c*, respectively, on the outsole member 700 to help hold the outsole member 700 and the midsole member 800 in place with respect to one another. Notably, to match with their corresponding parts on the outsole member 700, groove area 812*a* is provided in the heel to mid-foot area and runs substantially in a longitudinal direction of the midsole member 800, grooved area 812*b* is provided in the mid-foot to toe area and runs substantially in a longitudinal direction of the midsole member 800, and grooved area 812*c* is provided in the mid-foot to toe area and runs in a direction substantially transverse to the longitudinal direction of the midsole member 800. The longitudinal raised ribs 712*a* and 712*b* and corresponding midsole grooves 812*a* and 812*b* fit together and help prevent lateral movement of the midsole member 800 and outsole member 700 with respect to one another. The transverse rib 712*c* and corresponding groove 812*c* fit together and help prevent longitudinal movement of the midsole member 800 and outsole member 700 with respect to one another. Of course, as noted above, any number of raised ribs, corresponding grooves, ramped areas, and/or other engagement elements of any size, shape, orientation, construction, or arrangement may be used in the midsole member 800 and outsole member 700 without departing from the invention.

Figure 8B:
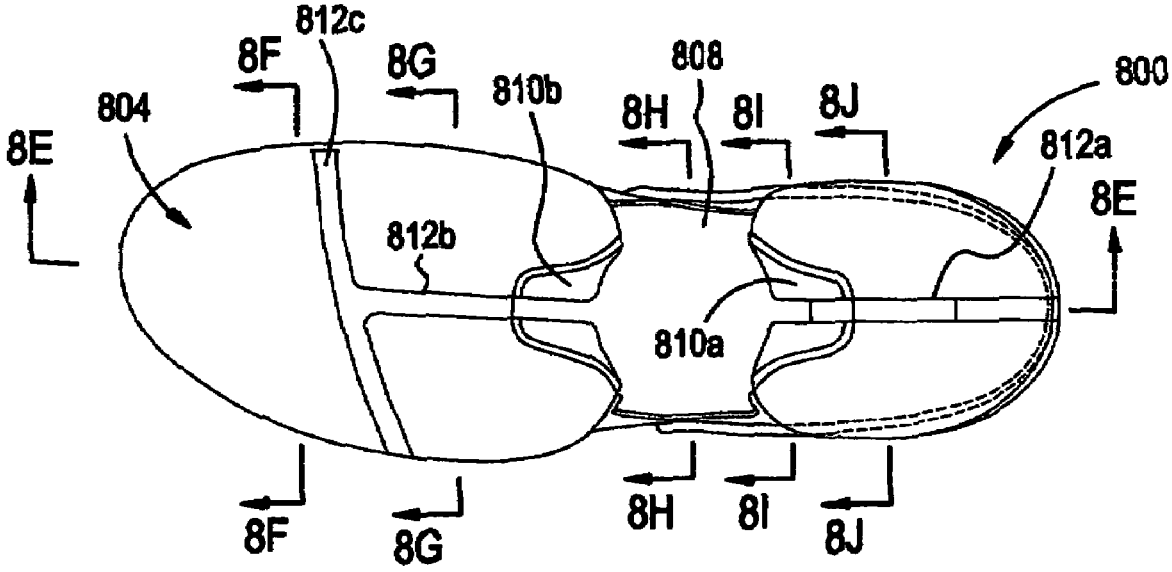

As further illustrated in FIG. 8B, the exterior major surface 804 of the midsole member 800 of this example does not include tread. In this example, the midsole member 800 also is made of a material that would not be particularly wear resistant, abrasion resistant, and/or supporting if used in direct contact with the ground surface during performance use in a manner consistent with the shoe's intended purpose. In other examples, however, if desired, the exterior major surface 804 of the midsole member may be designed for at least some limited use in direct contact with the ground without departing from the invention.

Figure 8C:
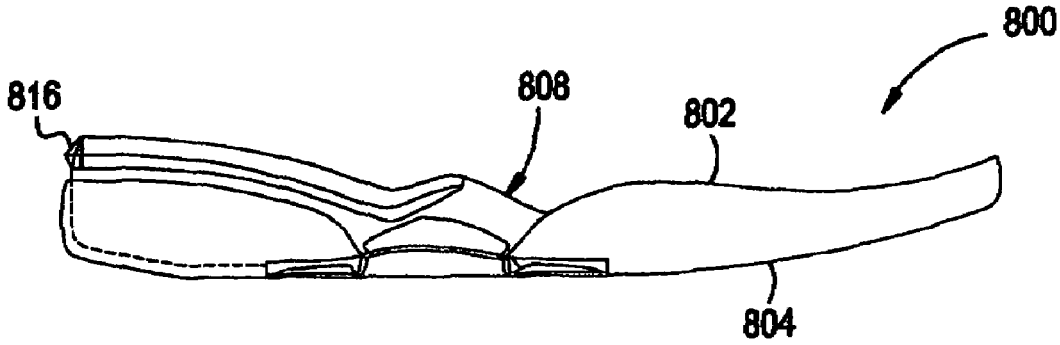
Figure 8D:
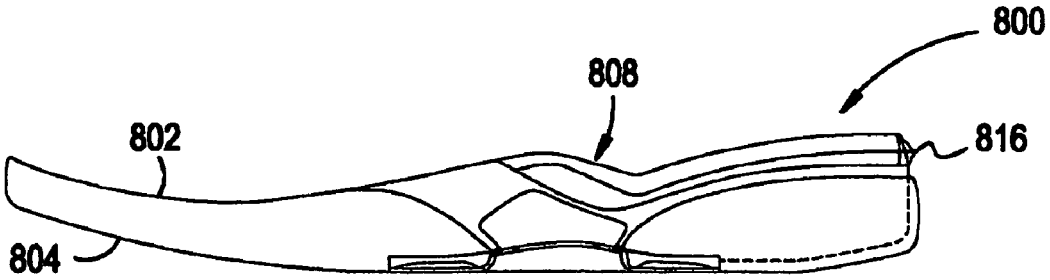

FIGS. 8C and 8D illustrate lateral and medial sides views, respectively, of the midsole member 800, with like parts from FIGS. 8A and 8B labeled with common reference numbers. Notably, a raised ridge 816 at the heel area defines a groove or slot into which at least a portion of heel tab 702 of the outsole member 700 can be received. Optionally, an audible sound and/or a visual indicator, as described above, will be apparent when the heel tab 702 is correctly located and seated in the raised ridge 816.

Figure 8E:
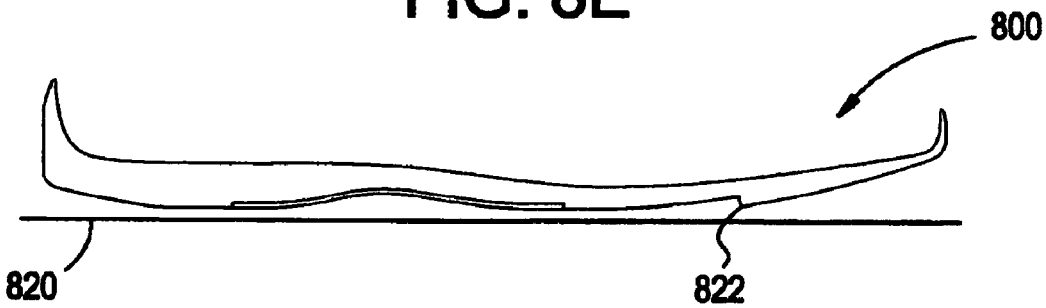
FIGS. 8E through 8J illustrate sectional views of the midsole member taken along lines 8E-8E, 8F-8F, 8G-8G, 8H-8H, 8I-8I, and 8J-8J, respectively, in FIG. 8B.

FIG. 8E illustrates a sectional view taken along line 8E-8E in FIG. 8B. Notably, section line 8E-8E runs through the grooves 812*a* and 812*b*, thus lifting the heel and mid-foot portions in FIG. 8E above the base line 820 and providing an edge 822 at the location where the section line 8E-8E leaves groove 812*c*.

Figure 8F:
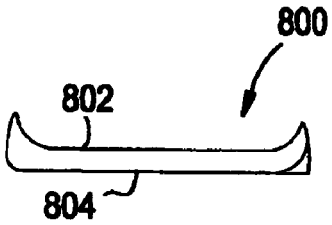
Figure 8G:
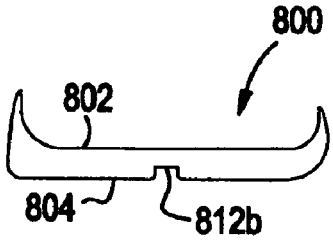

FIG. 8F is a sectional view taken along line 8F-8F in FIG. 8B. This drawing illustrates the interior and exterior major surfaces 802 and 804, respectively, of the midsole member 800. FIG. 8G is a sectional view taken along line 8G-8G in FIG. 8B. This drawing illustrates another portion of the interior and exterior major surfaces 802 and 804, respectively, of the midsole member 800, as well as the groove 812*b* in the exterior major surface 804 at the mid-foot area.

Figure 8H:
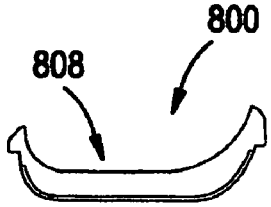
Figure 8I:
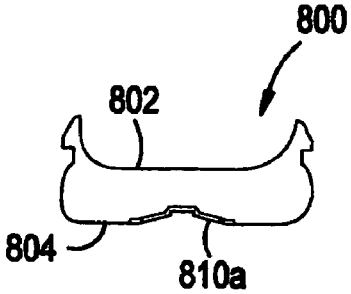
Figure 8J:
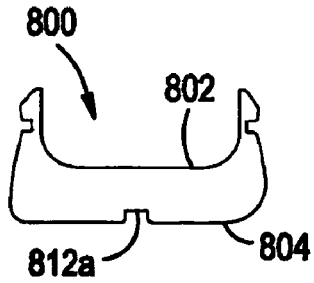

FIG. 8H is a sectional view taken along line 8H-8H in FIG. 8B. This drawing illustrates the raised portion 808 of the midsole member 800. FIGS. 8I and 8J are sectional views taken along lines 8I-8I and 8J-8J, respectively, in FIG. 8B. These drawings illustrate additional portions of the midsole member 800, in its mid-foot and heel areas. Additionally, FIG. 8I illustrates the ramped area 810*a*, and FIG. 8J illustrates the longitudinal groove 812*a*.

Of course, the above description and attached drawings merely provide examples of structures in accordance with some examples of the invention. Many variations in the specific structures of the upper, midsole, and outsole members are possible without departing from the invention. Additionally, additional elements and structures may be included in the overall footwear structures, and/or some of the above-described elements and structures may be omitted in the overall footwear structures without departing from the invention.

Figure 9:
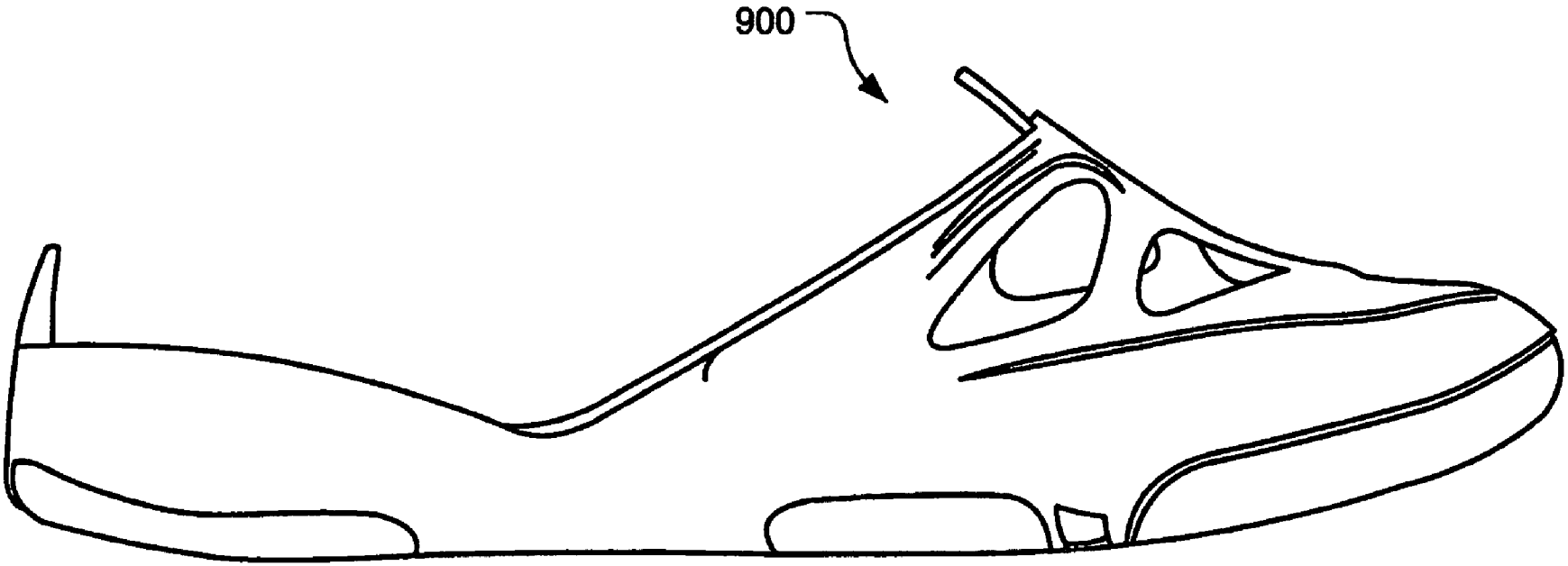
FIG. 9 illustrates a side view of another example removable outsole member in accordance with aspects of this invention.

One example of a potential structural variation relates to the arch area. Rather than an arched outsole bottom (e.g., ramped areas 710*a* and 710*b* and raised area 708 in the outsole member 700), the major exterior surfaces of some outsole members may be flattened in the arch region, as is the case in some conventional tennis shoe structures. FIG. 9 illustrates an example removable outsole member 900 having a more flattened bottom surface structure as compared to the structures shown in other figures. Flat "arch" areas of this type are particularly well suited, for example, for use on Omni-Court™ or clay court surfaces. Various traction element designs on the outsole member's major exterior surface also may be provided without departing from the invention, e.g., depending, at least in part, on the type of court surface on which play is to take place.

Another potential structural feature option or variation relates to the toe area. The toe area of footwear can receive substantial wear or abrasion, particularly in tennis shoes (e.g., from dragging the toe during a serve action, etc.). Accordingly, if desired in at least some examples of this invention, the toe area of an outsole member, a midsole member, or an upper member may be reinforced and/or formed of a thicker and/or stronger thermoplastic or other material, to prevent it from wearing through too quickly. As another example, the upper, midsole, and/or outsole members may be provided with a toe cap or toe bumper structure. The toe cap or toe bumper may be integrally formed with the remainder of the upper, midsole, or outsole structure, or it may be one or more separate elements that cover, attach to, insert into, mold with, and/or are otherwise combined with the upper, midsole, and/or outsole members. When one or more separate elements, the toe cap or bumper may be fixedly engaged with the upper, midsole, and/or outsole structure, or it/they may be removable therefrom (and optionally separately replaceable when worn).

Figure 10A:
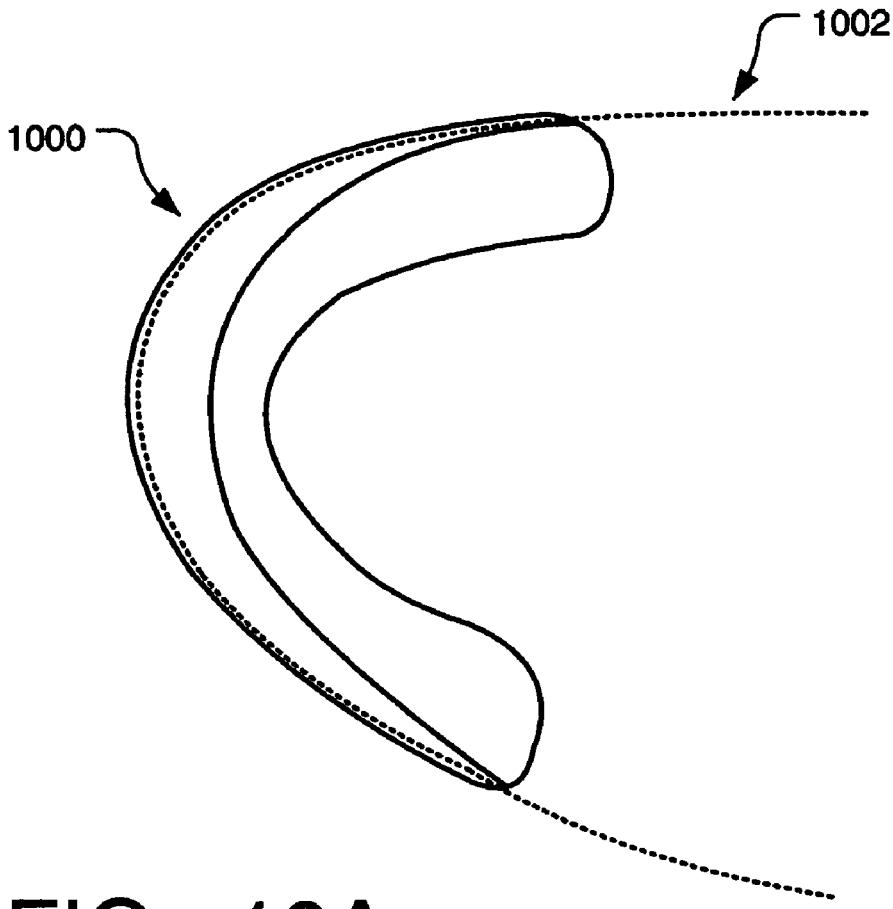
FIGS. 10A and 10B illustrate an example toe cap member that may be used in accordance with some example aspects of this invention.
Figure 10B:
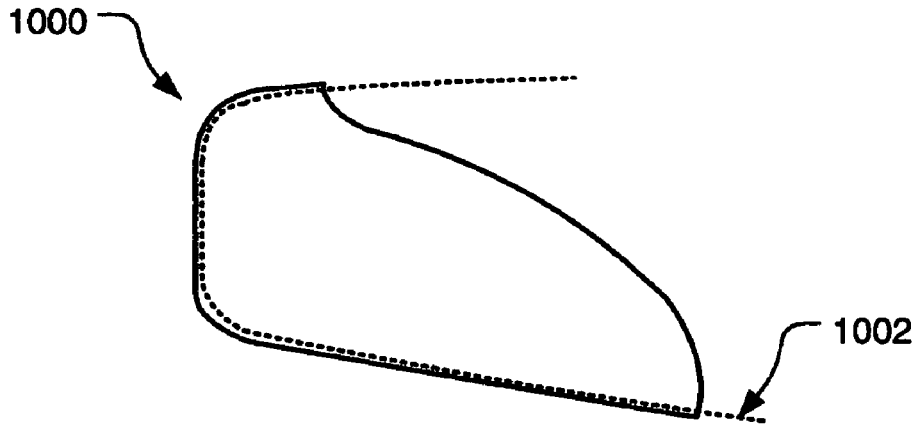

FIGS. 10A and 10B illustrate overhead and side views, respectively, of an example toe cap member 1000 useful in at least some examples of this invention. In this example structure, the toe cap 1000 is formed as a separate piece attached with the shoe base portion. As an example, the toe cap member 1000 may define a chamber for receiving at least a portion of the toe area of the upper member 1002 (the upper member 1002 is shown in broken lines in FIGS. 10A and 10B). The toe cap member 1000 may be adhesively (or otherwise) engaged with the upper member 1002 and/or the midsole member, e.g., using urethane-based cement or other adhesive, including conventional adhesives known and used in the art. The toe cap 1000 also may be of any desired design, including conventional designs known in the art. While any suitable or desired materials may be used for the toe cap 1000 construction without departing from the invention, including conventional materials, as more specific examples, the toe cap member 1000 in at least some examples may be made from synthetic rubber materials, thermoplastic polyurethane materials e.g., having a 70 Shore A hardness or harder, e.g., like those materials that may be used, in at least some examples, in the removable outsole member's construction (or even somewhat harder than those materials, if desired). In use, a removable outsole member in accordance with examples of this invention may then fit over the toe cap member 1000. In addition to protecting the front toe portion of the upper member 1002 (e.g., should the outsole member wear through at the toe), the toe cap 1000 also advantageously covers a gathering stitch located at the toe of the upper pattern in some example upper member structures 1002, e.g., the toe cap 1000 may cover a seam where the upper pattern typically is split for construction and/or manufacturing purposes.

Figure 11:
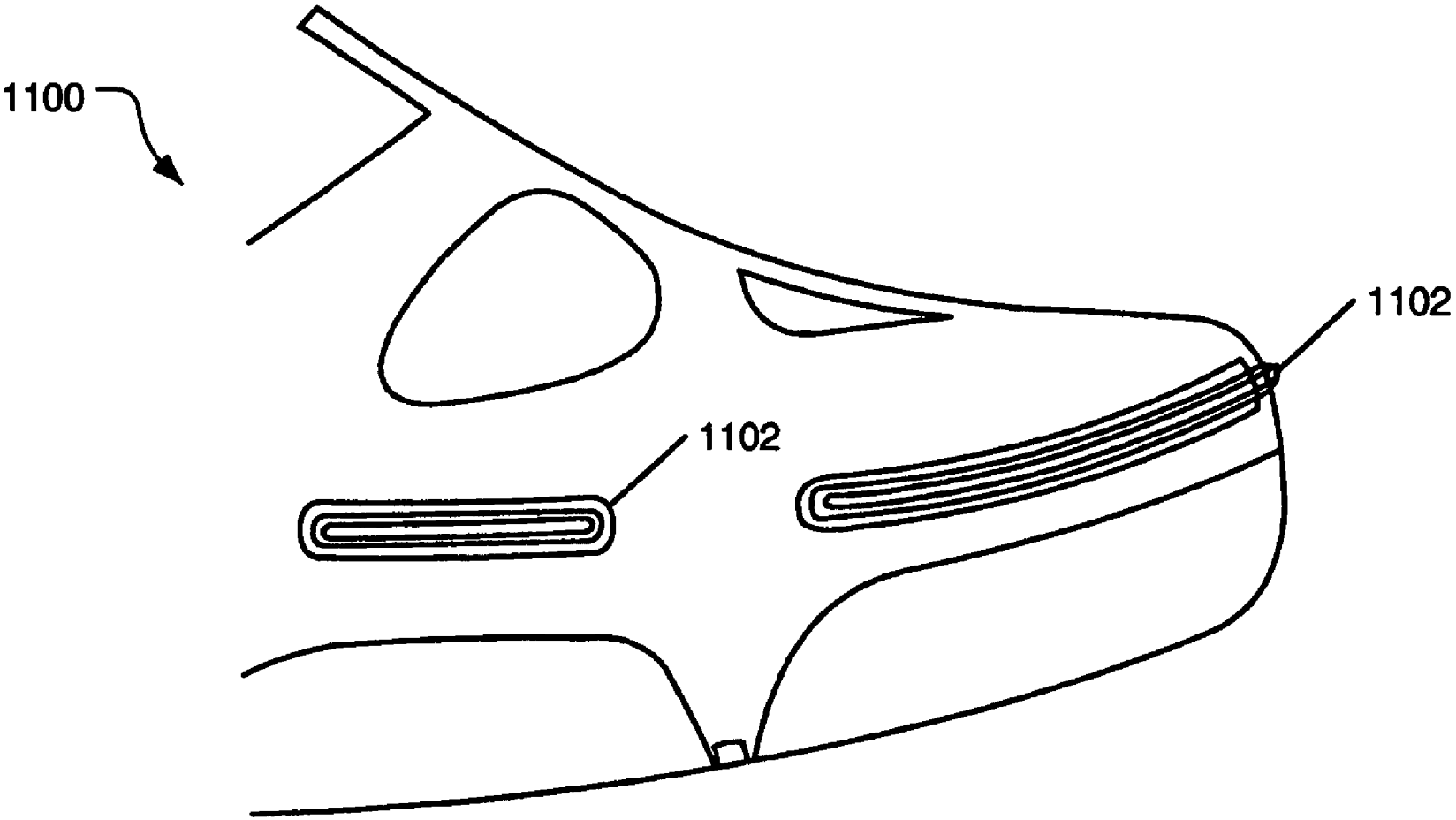
FIG. 11 illustrates a side view of another example removable outsole member including toe bumper elements in accordance with example aspects of this invention.

FIG. 11 illustrates an example removable outsole member 1100 having bumper elements 1102 at the toe area. Any desired process for including the bumper elements 1102 in the outsole member structure 1100 may be used without departing from the invention. For example, bumper elements 1102 may be integrally formed with the outsole member structure 1100, e.g., by insert molding them into the outsole structure 1100. As another example, the bumper elements 1102 may be separately formed and fixed to the outsole structure 1100 by cements, adhesives, or in any other desired manner.

The bumper elements 1102 may be made from any desired material without departing from the invention, including the same materials that make up the outsole member structure 1100. In some examples of the invention, the bumper elements 1102 are insert molded from a somewhat higher durometer thermoplastic polyurethane material than that making up the remainder of the outsole member structure 1100 (e.g., thermoplastic polyurethane materials having a 70 Shore A hardness or harder), to further increase their wear and/or abrasion resistance. As shown in FIG. 11, the bumper elements 1102 of this example protrude somewhat from the main surface of the outsole member 1100 so that the bumper elements 1102 will wear first (e.g., when the wearer drags his toe during a serve action, etc.). Of course, any desired number of bumper elements 1102, at any desired locations on the outsole, midsole, or upper member structures, may be provided without departing from this invention.

Footwear systems in accordance with at least some examples of the invention may include a footwear base portion (e.g., an upper member with a midsole member fixed thereto) with one or more sets of outsole members included with them (optionally, one set of outsole members may be removably attached to the base portion so that the footwear system is ready for use). Alternatively (or additionally), the footwear system may include a means to allow the user to obtain another set of outsole members. The "means" for obtaining an additional set of outsole members may include one or more coupons, codes, data, or other information, redeemable or useable by mail, over the telephone, in person at a point-of-sale location, over a computer network, or the like, that allows a user to obtain another set of outsole members, optionally for free or at a discount price. If desired, the user may be given a choice as to the type of additional outsole member to be obtained using this "means" (e.g., whether the new outsole members will be exact replacements for an original set or if they will be designed for use under different conditions, on different ground surfaces, different colors, etc.). Similarly, in footwear systems that come with plural outsole member sets, the various sets may match one another or be optimized for use under different conditions and/or on different surfaces, optionally at the ultimate end user's choice. As still another example, replacement outsole members, individually or in paired sets, etc., may be marketed or otherwise be made available to users.

Various additional potential advantages and/or uses of structures and methods in accordance with examples of this invention are available or possible. For example, if desired, team members could wear a common style of footwear products including a commonly appearing removable outsole member according to the invention, and they could change the color, style, or other aesthetic characteristics of the outsole member depending on any desired factor (e.g., wear one color for home matches and a different color for away matches, to match a partner's outsoles, etc.). Individuals and/or team members also could change outsole members, if desired, for any reason, e.g., to change colors and/or styles for aesthetic purposes, etc. An individual that plays on multiple teams or multiple different types of surfaces can use the same footwear base and change outsole members to match the new team or type of play surface. As another example, players or teams may wear special outsole members to commemorate special people, matches, or events, such as outsole members including a special or former coach's or player's name, a special match or championship logo, a sponsor's logo, one color or style for home matches and a different color or style for away matches, etc. Any desired information, logos, or other indicia may be included on the outsole members without departing from the invention.

While specific processes and structures in accordance with the invention are described in detail above, those skilled in the art will appreciate that these descriptions merely constitute examples of processes and structures in accordance with this invention. The skilled artisan will appreciate that the various structures, materials, process steps, process conditions, and the like may vary widely and may include additional structures or elements without departing from the invention. Additionally, the skilled artisan will appreciate that variations in the process steps also may occur without departing from the invention. For example, specific steps described above may be omitted, changed, changed in order, and the like without departing from the invention. Also, additional steps may be included between the various steps described above, and/or long time periods may elapse between steps without departing from aspects of this invention. The various parts of footwear systems according to examples of the invention also may be made in any desired manner, including in conventional manners known in the art (e.g., injection molding to form the midsole and outsole members, etc.).

D. CONCLUSION

Various examples of the present invention have been described above, and it will be understood by those of ordinary skill that the present invention includes within its scope all combinations and subcombinations of these examples. Additionally, those skilled in the art will recognize that the above examples simply exemplify the invention. Various changes and modifications may be made without departing from the spirit and scope of the invention, as defined in the appended claims.

The invention claimed is:

1. A piece of footwear, comprising:

an upper member including a closure system;

a midsole member fixedly engaged with the upper member and having a side region, wherein an exterior major surface of the midsole member includes at least a first engagement element, and wherein at least a major portion of the exterior major surface is not designed for performance use in direct contact with a ground surface; and an outsole member removably attachable over at least the major portion of the exterior major surface of the midsole member, the outsole member covering a first portion of the side region of the midsole while exposing a second portion of the side region of the midsole, wherein the exposed portion of the side region extends from an edge contacting the upper to a bottom edge of the side region of the midsole, wherein an interior major surface of the outsole member includes at least a second engagement element that engages with the first engagement element of the midsole member, wherein an exterior major surface of the outsole member is designed for performance use in direct contact with the ground surface, and wherein the outsole member further includes an upper containing region that extends over and partially contains the upper member, wherein the upper containing region at least partially covers the closure system.

2. A piece of footwear according to claim 1, further comprising:

a first attachment element located at a heel area of the midsole member; and a second attachment element located at a heel area of the outsole member, wherein the second attachment element is engagable with the first attachment element to at least partially attach the outsole member with the midsole member.

3. A piece of footwear according to claim 2, wherein proper engagement of the first attachment element and the second attachment element produces a proper engagement indication.

4. A piece of footwear according to claim 3, wherein the proper engagement indication is at least one of an audible or visual indication.

5. A piece of footwear according to claim 1, wherein the outsole member is constructed from an elastomeric material such that at least some portion of the outsole member stretches when attached over the midsole member.

6. A piece of footwear according to claim 1, further comprising:

a first outsole element attached to the exterior major surface of the outsole member.

7. A piece of footwear according to claim 6, wherein the first outsole element is a different color from the exterior major surface of the outsole member such that the exterior major surface of the outsole member acts as a wear indicator for the first outsole element.

8. A piece of footwear according to claim 1, wherein the exterior major surface of the outsole member has at least a portion made from a first color material, and wherein the outsole member further includes a wear indicator portion made from a second color material.

9. A piece of footwear according to claim 1, wherein the upper member is attachable to the upper containing region of the outsole member using the closure system.

10. A piece of footwear according to claim 1, further comprising:

a wear indicator portion included with the outsole member.

11. A piece of footwear according to claim 10, wherein the wear indicator portion is located between the exterior major surface of the outsole member and the interior major surface of the outsole member.

12. A piece of footwear according to claim 1, wherein the first engagement element includes a groove defined in the exterior major surface of the midsole member and the second engagement element includes a raised rib defined in the interior major surface of the outsole member, wherein the raised rib fits in the groove.

13. A piece of footwear according to claim 1, wherein the first engagement element includes a raised rib defined in the exterior major surface of the midsole member and the second engagement element includes a groove defined in the interior major surface of the outsole member, wherein the raised rib fits in the groove.

14. A piece of footwear according to claim 1, wherein at least a portion of the exterior major surface of the outsole member is constructed from an elastomeric material having at least a 60 Shore A hardness.

15. A piece of footwear according to claim 1, wherein the footwear is designed for use in playing tennis.

16. A piece of footwear according to claim 1, wherein the outsole member is designed for use in playing tennis on a hardcourt surface.

17. A piece of footwear, comprising:

an upper member including a closure system;

a midsole member fixedly engaged with the upper member and having a side region, wherein an exterior major surface of the midsole member includes at least a first groove element defined therein; and an outsole member removably attachable over at least the major portion of the exterior major surface of the midsole member, the outsole member covering a first portion of the side region of the midsole while exposing a second portion of the side region of the midsole, wherein the exposed portion of the side region extends from an edge contacting the upper to a bottom edge of the side region of the midsole, wherein an interior major surface of the outsole member includes at least a first raised rib element that engages with the first groove element defined in the midsole member, and wherein the outsole member further includes an upper containing region that extends over and partially contains the upper member, wherein the upper containing region at least partially covers the closure system.

18. A piece of footwear according to claim 17, wherein the first groove element extends in substantially a longitudinal direction of the midsole member and the first raised rib element extends in substantially a longitudinal direction of the outsole member.

19. A piece of footwear according to claim 18, wherein the exterior major surface of the midsole member includes a second groove element defined therein, and wherein the interior major surface of the outsole member includes a second raised rib element that engages with the second groove element.

20. A piece of footwear according to claim 19, wherein the second groove element extends in a direction substantially transverse to the longitudinal direction of the midsole member and the first raised rib element extends in a direction substantially transverse to the longitudinal direction of the outsole member.

21. A piece of footwear according to claim 19, wherein the second groove element extends substantially in the longitudinal direction of the midsole member and the first raised rib element extends in substantially the longitudinal direction of the outsole member.

22. A piece of footwear according to claim 17, wherein the outsole member is constructed from an elastomeric material such that at least some portion of the outsole member stretches when attached over the midsole member.

23. A piece of footwear according to claim 17, further comprising:

a first outsole element attached to the exterior major surface of the outsole member.

24. A piece of footwear according to claim 23, wherein the first outsole element is a different color from the exterior major surface of the outsole member such that the exterior major surface of the outsole member acts as a wear indicator for the first outsole element.

25. A piece of footwear according to claim 17, wherein the first groove extends in a direction substantially transverse to a longitudinal direction of the midsole member and the first raised rib extends in a direction substantially transverse to a longitudinal direction of the outsole member.

26. A piece of footwear according to claim 17, wherein the upper member is attachable to the upper containing region of the outsole member using the closure system.

27. A piece of footwear according to claim 17, wherein at least one of the exterior major surface of the midsole member and the interior major surface of the outsole member includes a composition applied thereto that increases a coefficient of friction between the exterior major surface of the midsole member and the interior major surface of the outsole member.

28. A piece of footwear according to claim 17, further comprising:

a first attachment element located at a heel area of the midsole member or the upper member; and a second attachment element located at a heel area of the outsole member, wherein the second attachment element is engagable with the first attachment element to at least partially attach the outsole member with the midsole member or the upper member.

29. A piece of footwear according to claim 28, wherein proper engagement of the first attachment element and the second attachment element produces a proper engagement indication.

30. A piece of footwear according to claim 29, wherein the proper engagement indication is at least one of an audible or visual indication.

31. A piece of footwear according to claim 17, wherein the exterior major surface of the outsole member has at least a portion made from a first color material, and wherein the outsole member further includes a wear indicator portion made from a second color material.

32. A piece of footwear according to claim 17, wherein at least a portion of the exterior major surface of the outsole member is constructed from an elastomeric material having at least a 60 Shore A hardness.

33. A piece of footwear according to claim 17, wherein the footwear is designed for use in playing tennis.

34. A piece of footwear according to claim 17, wherein the outsole member is designed for use in playing tennis on a hardcourt surface.

35. A piece of footwear according to claim 17, further comprising:

a wear indicator portion included with the outsole member.

36. A piece of footwear according to claim 35, wherein the wear indicator portion is located between the exterior major surface of the outsole member and the interior major surface of the outsole member.

37. A footwear system, comprising:

a first shoe base including: (a) a first upper member having a first closure system, and (b) a first midsole member fixedly engaged with the first upper member and including a first side region, wherein at least a major portion of an exterior major surface of the first midsole member is not designed for performance use in direct contact with a ground surface;

a second shoe base including: (a) a second upper member having a second closure system, and (b) a second midsole member fixedly engaged with the second upper member and including a second side region, wherein at least a major portion of an exterior major surface of the second midsole member is not designed for performance use in direct contact with the ground surface;

a first outsole member removably attachable over at least the major portion of the exterior major surface of the first midsole member, the first outsole member covering a first portion of the first side region while exposing a second portion of the first side region, wherein the exposed second portion of the first side region extends from an edge contacting the upper to a bottom edge of the first side region of the midsole, wherein an exterior major surface of the first outsole member is designed for performance use in direct contact with the ground surface, and wherein the first outsole member further includes a first upper containing region that extends over and partially contains the first upper member, wherein the first upper containing region at least partially covers the first closure system;

a second outsole member removably attachable over at least the major portion of the exterior major surface of the second midsole member, the second outsole member covering a first portion of the second side region while exposing a second portion of the second side region, wherein the exposed second portion of the second side region extends from an edge contacting the upper to a bottom edge of the second side region of the midsole, wherein an exterior major surface of the second outsole member is designed for performance use in direct contact with the ground surface, and wherein the second outsole member further includes a second upper containing region that extends over and partially contains the second upper member, wherein the second upper containing region at least partially covers the second closure system;

a third outsole member removably attachable over at least the major portion of the exterior major surface of the first midsole member, the third outsole member covering the first portion of the first side region while exposing the second portion of the first side region, wherein the exposed second portion of the first side region extends from an edge contacting the upper to a bottom edge of the first side region of the midsole, wherein an exterior major surface of the third outsole member is designed for performance use in direct contact with the ground surface, and wherein the third outsole member further includes a third upper containing region that extends over and partially contains the first upper member, wherein the third upper containing region at least partially covers the first closure system; and a fourth outsole member removably attachable over at least the major portion of the exterior major surface of the second midsole member. the fourth outsole member covering a the first portion of the second side region while exposing the second portion of the second side region, wherein the exposed second portion of the second side region extends from an edge contacting the upper to a bottom edge of the second side region of the midsole, wherein an exterior major surface of the fourth outsole member is designed for performance use in direct contact with the ground surface, and wherein the fourth outsole member further includes a fourth upper containing region that extends over and partially contains the second upper member, wherein the fourth upper containing region at least partially covers the second closure system.

38. A footwear system according to claim 37, wherein each of at least the first outsole member and the second outsole member further includes at least one outsole element attached to its exterior major surface.

39. A footwear system according to claim 37, wherein the at least some portion of the outsole elements are a different color from the exterior major surfaces of the outsole members such that the exterior major surfaces of the outsole member act as wear indicators for said portions of the outsole elements.

40. A footwear system according to claim 37, wherein: (a) the exterior major surface of the first midsole member includes a first engagement element, (b) an interior major surface of the first outsole member includes a second engagement element engagable with the first engagement element, and (c) an interior major surface of the third outsole member includes a third engagement element engagable with the first engagement element; and wherein: (a) the exterior major surface of the second midsole member includes a fourth engagement element, (b) an interior major surface of the second outsole member includes a fifth engagement element engagable with the fourth engagement element, and (c) an interior major surface of the fourth outsole member includes a sixth engagement element engagable with the fourth engagement element.

41. A footwear system according to claim 40, wherein: (a) the first engagement element includes a groove defined in the exterior major surface of the first midsole member, (b) the second engagement element includes a raised rib defined in the interior major surface of the first outsole member that fits in the groove of the first midsole member, and (c) the third engagement element includes a raised rib defined in the interior major surface of the third outsole member that fits in the groove of the first midsole member; and wherein: (a) the fourth engagement element includes a groove defined in the exterior major surface of the second midsole member, (b) the fifth engagement element includes a raised rib defined in the interior major surface of the second outsole member that fits in the groove of the second midsole member, and (c) the sixth engagement element includes a raised rib defined in the interior major surface of the fourth outsole member that fits in the groove of the second midsole member.

42. A footwear system according to claim 37, wherein the first and second outsole members are designed for use on a first ground surface type and the third and fourth outsole members are designed for use on a second ground surface type that differs from the first ground surface type.

43. A footwear system according to claim 42, wherein the first ground surface type is a first type of tennis court surface and the second ground surface type is a second type of tennis court surface.

44. A footwear system according to claim 37, wherein the first, second, third, and fourth outsole members are designed for use on a first ground surface type.

45. A footwear system according to claim 44, wherein the first ground surface type is a tennis court surface.

46. A footwear system according to claim 37, wherein the footwear system is designed for use in playing tennis.

* * * * *